US008608455B2

(12) United States Patent
Ishida et al.

(10) Patent No.: US 8,608,455 B2
(45) Date of Patent: Dec. 17, 2013

(54) FLUID ROTARY MACHINE

(75) Inventors: Naoya Ishida, Inazawa (JP); Isao Shimazu, Inazawa (JP); Fumito Komatsu, Shiojiri (JP)

(73) Assignees: Nippo Ltd., Aichi (JP); Yugen Kaisha K.R & D, Nagano (JP)

( * ) Notice: Subject to any disclaimer, the term of this patent is extended or adjusted under 35 U.S.C. 154(b) by 0 days.

(21) Appl. No.: 13/704,035

(22) PCT Filed: Jul. 19, 2011

(86) PCT No.: PCT/JP2011/066384

§ 371 (c)(1),
(2), (4) Date: Dec. 13, 2012

(87) PCT Pub. No.: WO2012/017820

PCT Pub. Date: Feb. 9, 2012

(65) Prior Publication Data

US 2013/0133511 A1 May 30, 2013

(30) Foreign Application Priority Data

Aug. 2, 2010 (JP) ..... 2010-173522

(51) Int. Cl.
*F04B 1/04* (2006.01)
*F04B 7/00* (2006.01)
*F04B 39/10* (2006.01)

(52) U.S. Cl.
USPC ..... 417/273; 417/532; 417/510; 417/519

(58) Field of Classification Search
USPC ..... 417/510, 269, 270–271, 273, 515–519, 417/532; 91/491
See application file for complete search history.

(56) References Cited

U.S. PATENT DOCUMENTS

| | | | | |
|---|---|---|---|---|
| 2,889,783 | A * | 6/1959 | Woydt | 91/186 |
| 4,352,640 | A * | 10/1982 | Takamatsu et al. | 417/273 |
| 4,907,950 | A * | 3/1990 | Pierrat | 417/271 |
| 5,004,404 | A * | 4/1991 | Pierrat | 417/53 |
| 6,692,237 | B1 * | 2/2004 | Komatsu et al. | 417/273 |
| 6,752,064 | B2 * | 6/2004 | Wheeler | 91/493 |
| 7,273,004 | B2 * | 9/2007 | Kuhn | 92/72 |
| 2007/0240563 | A1 * | 10/2007 | Kovach et al. | 91/491 |
| 2012/0177524 | A1 * | 7/2012 | Komatsu | 418/161 |

FOREIGN PATENT DOCUMENTS

| | | | |
|---|---|---|---|
| JP | 56-141079 | A | 11/1981 |
| JP | 11-082287 | A | 3/1999 |
| JP | 4553977 | B1 | 9/2010 |

* cited by examiner

*Primary Examiner* — Charles Freay
*Assistant Examiner* — Alexander Comley
(74) *Attorney, Agent, or Firm* — Birch, Stewart, Kolasch & Birch, LLP

(57) ABSTRACT

A fluid rotary machine with a decreased footprint and a reduction in the number of parts. The fluid rotary machine has four heads wherein double-headed pistons are disposed inside cylinders in a crisscross arrangement. The rotational balance between rotational parts including the double-headed pistons is achieved only by first and second balance weights which are inserted and incorporated into both ends of a crank shaft coupled eccentrically to a shaft. The shaft is rotated for the double-headed pistons to linearly reciprocate in the cylinders. The fluid rotary machine has rotary valves for switching between the suction and discharge operations of the fluid for each cylinder chamber. The rotary valves are incorporated into a case to be coaxial and integrally rotatable with the shaft.

6 Claims, 22 Drawing Sheets

FIG7.D

SECTION D-D

SECTION E-E

SECTION F-F

SECTION G-G

FIG.10.B

POSITIONS OF PISTONS
DISCHARGE
SUCTION
23
23b
24
24b
25a
25b
25c
25d
7
8

23
23b
24
24b
25a
25b
25c
25d
7
8
DISCHARGE
SUCTION
POSITIONS OF PISTONS

FIG.13A
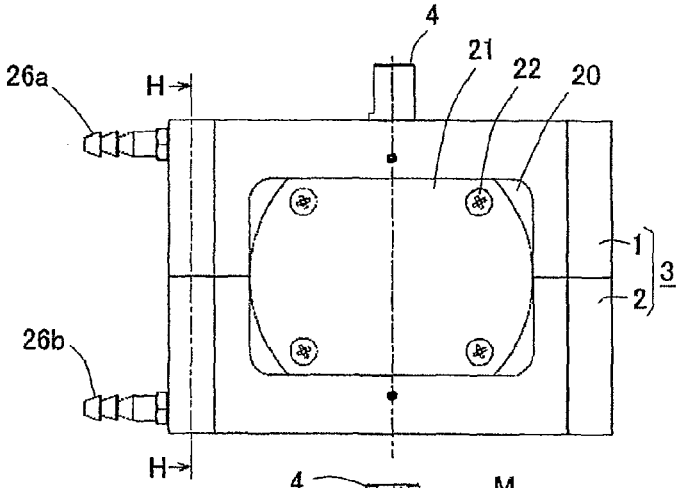
FIG.13B
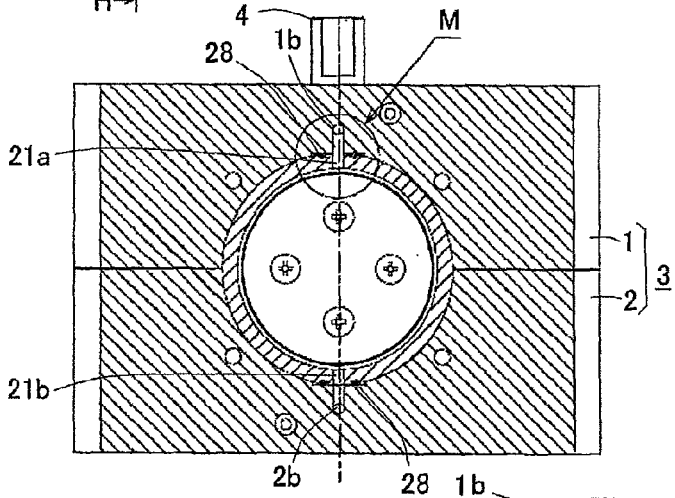
SECTION H-H
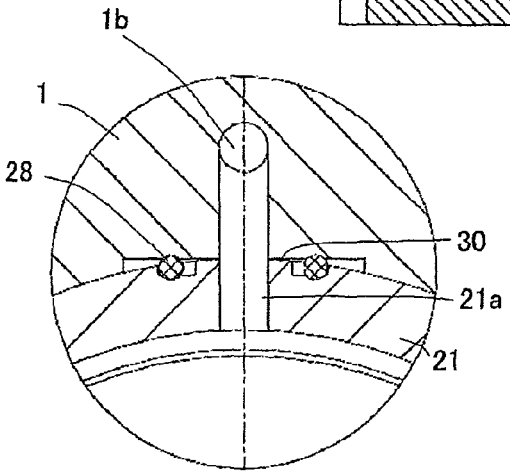
ENLARGED PART "M"
FIG.13C
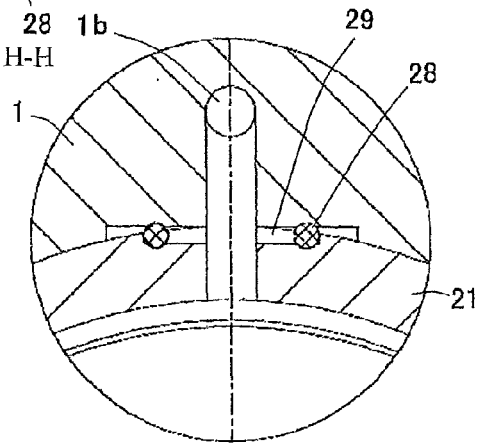
ENLARGED PART "M"
FIG.13D 23
23b
24
24b
25a
25b
25c
25d
7
8
DISCHARGE
SUCTION
POSITIONS OF PISTONS POSITIONS OF PISTONS
23
23b
25a
25b
25c
25d
DISCHARGE
7
8
24
24b
SUCTION FIG.20E
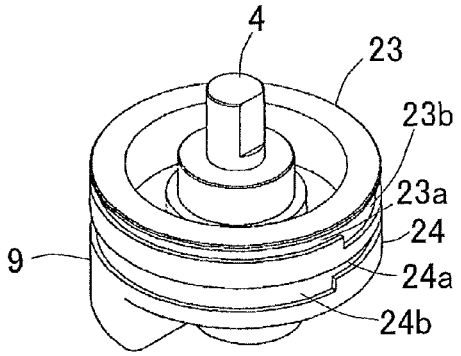
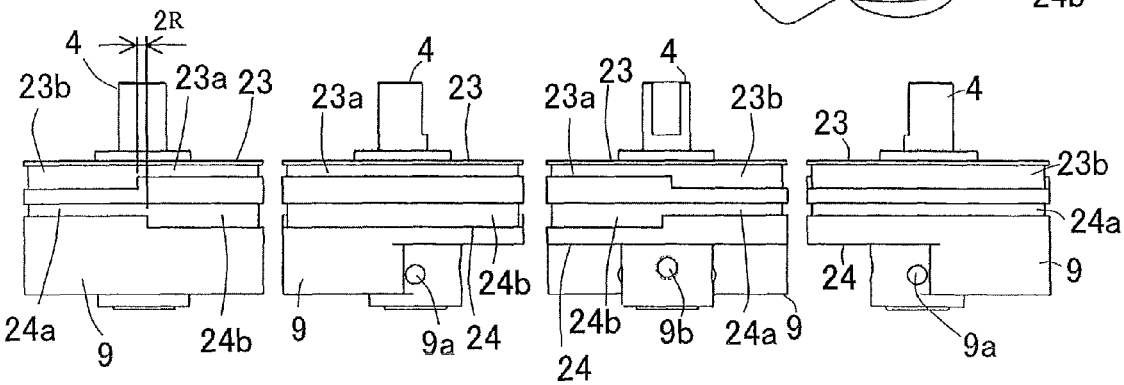
FIG.20C FIG.20B FIG.20A FIG.20D FIG.21A
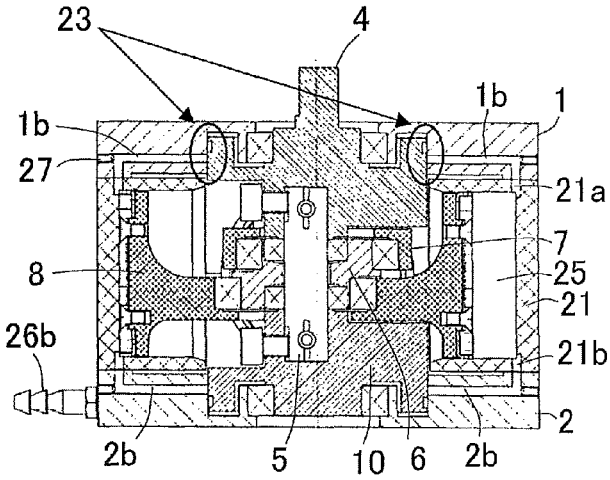
FIG.21B
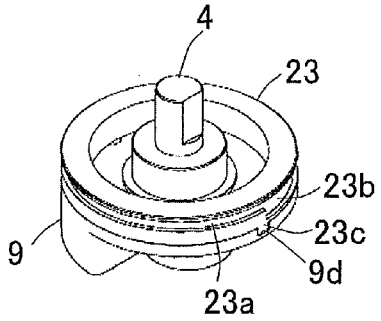
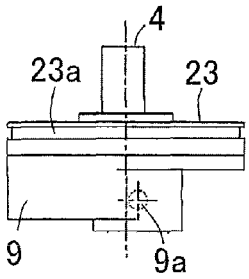
FIG.21D
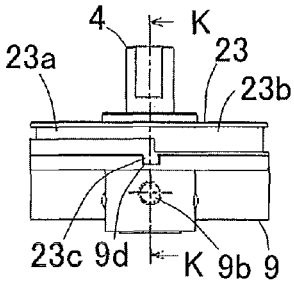
FIG.21C
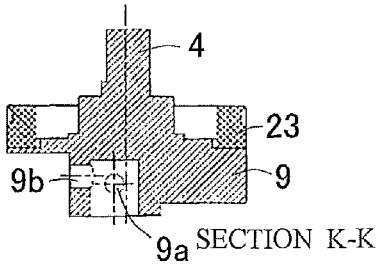
FIG.21E
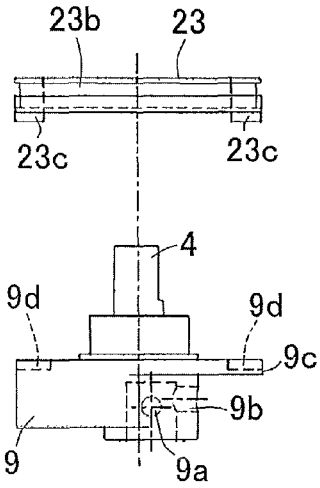
FIG.21G
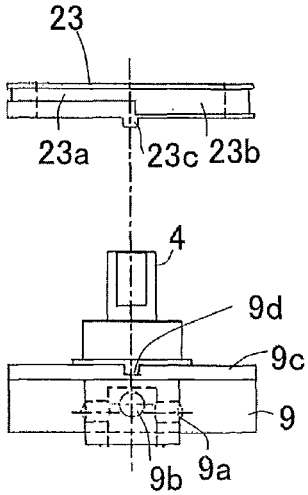
FIG.21F
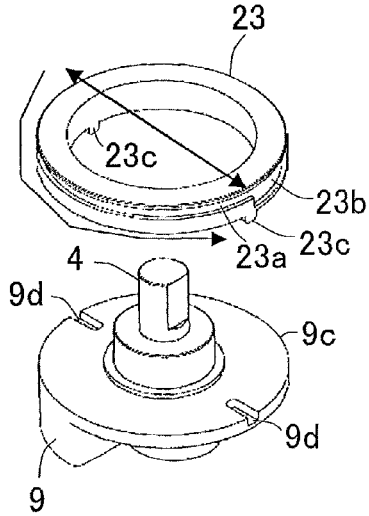
FIG.21H

SECTION L-L

FLUID ROTARY MACHINE

FIELD OF TECHNOLOGY

The present invention relates to a fluid rotary machine, e.g., pneumatic pump, liquid pump, vacuum pump, pneumatic compressor, multistage compressor, fluid motor.

BACKGROUND OF TECHNOLOGY

In a fluid rotary machine, e.g., pneumatic pump, liquid pump, a reciprocating drive mechanism, in which a piston assembly connected to a crank shaft is reciprocated to repeatedly suck and discharge a fluid, is mainly employed; further, a rotary type compact fluid rotary machine, which has a long stroke, in which double-head pistons are disposed in a crisscross arrangement and in which the double-head pistons connected to a crank shaft are linearly reciprocated, on the basis of the principle of hypocycloid, by rotating a shaft so as to repeatedly suck and discharge the fluid, is also provided (see Patent Document 1).

PRIOR ART DOCUMENT

Patent Document

Patent Document 1: Japanese Laid-open Patent Publication No. P56-141079

DISCLOSURE OF THE INVENTION

Problems to be Solved by the Invention

In a fluid pump 501 shown in FIG. 27, which is an example of the above described rotary machine, each of four cylinders, in which a head of double-headed pistons slide, should have a suction port 502 and a discharge port 503, and a suction valve and a discharge valve constituted by leaf springs, not shown, are required. With this structure, number of parts must be increased, a piping structure including pipes (tubes) connected to the suction ports and discharge ports must be complicated, and a space for installing must be large.

As shown in FIG. 28, in case that an open-close valve 505, which is used to suck a fluid into and discharge the fluid from each of cylinder chambers 504, is constituted by a leaf spring and used to suck (discharge) the fluid, the structure should satisfy the following formula: (fluid pressure F1)×(sectional are of a path A)>(spring force of the leaf spring)+(fluid pressure F0 applied to the leaf spring in a cylinder chamber)×(surface area of ϕB part of the leaf spring), so pressure loss for opening and closing the valve must be increased.

An object of the present invention is to provide a fluid rotary machine whose footprint can be decreased by reducing number of parts and simplifying valve structure as well as by reducing externally coupled pipes used for suction and discharge of a fluid.

Means for Solving the Problems

To achieve the object, the present invention has following structures.

A four-head fluid rotary machine comprises: a first crank shaft being eccentrically connected to a shaft, the first crank shaft being rotated about the shaft by a first imaginary crank arm which has a radius r; a piston composite body having an eccentric tube body constituted by a first tube body, which is concentrically fitted to the first crank shaft, and second tube bodies, which are extended from the both axial ends of the first tube body and whose axes are second imaginary crank shafts eccentrically disposed with respect to the axis of the first tube body, a first double-headed piston, which is fitted in one of the second tube bodies, and a second double-headed piston, which is fitted in the other second tube body, being disposed inside cylinders in a crisscross arrangement, the piston composite body being rotated about the first crank shaft, by a second imaginary crank arm which has a radius r; and a first balance weight and a second balance weight being respectively inserted and incorporated into both ends of the first crank shaft, the double-headed pistons linearly reciprocate in the cylinders in a state where a first rotational balance relating to the first and second double-headed pistons around the second imaginary crank shafts, a second rotational balance relating to the piston composite body around the first crank shaft and a third rotational balance relating to the first crank shaft and the piston composite body around the shaft are achieved only by the first and second balance weights, and the fluid rotary machine is characterized in that rotary valves switch between the suction and discharge operations of the fluid for each cylinder chamber, and that the rotary valves are incorporated into a case to be coaxial and integrally rotatable with the shaft.

With this structure, the double-headed pistons are linearly reciprocated by rotating the shaft, and the suction and discharge operations of the fluid for each cylinder chamber can be performed by the rotary valves, which are incorporated into the case to be coaxial and integrally rotatable with the shaft. Therefore, number of tubes connected to a suction port and a discharge port of each cylinder chamber can be reduced to one, structures of the valves can be simplified by reducing number of parts, so that footprint of the machine can be reduced.

Further, the rotational balance between rotational parts including the double-headed pistons is achieved only by the first and second balance weights which are inserted and incorporated into both ends of the crank shaft, vibration caused by rotating the machine can be restrained and operation loss can be reduced.

Note that, in the above described structure where the double-headed pistons are disposed inside the cylinders in the crisscross arrangement and the double-headed pistons are linearly reciprocated by rotating the shaft, the first crank shaft having the radius r is rotated about the shaft and the piston composite body including the double-headed pistons is rotated about the first crank shaft, so that the first and second double-headed pistons are linearly reciprocated in the radial direction of a rolling circle of the second imaginary crank shaft, which has a radius 2r, (along the hypocycloid track).

Preferably, the rotary valves are suction valves and discharge valves.

With this structure, the rotary valves are the suction valves for sucking the fluid and the discharge valves for discharging the fluid, so that eight valves of the four-head fluid rotary machine can be minimized to two valves.

Preferably, a passage groove whose width is partially varied is formed on an outer circumferential face of each of the rotary valves and extended in the circumferential direction, and a first fluid path, which communicates the passage groove to an external path, and a second fluid path, which communicates the passage groove to the cylinder chambers, are formed in the case.

With this structure, the first fluid path is used as a fluid path for sucking and introducing the fluid to the external path and a fluid path in the case is commonly used, so that a pipe or tube can be omitted and the piping structure can be simplified.

Preferably, the rotary valves are integrated with the first and second balance weights, which are respectively incorporated into the both ends of the first crank shaft, each of the passage grooves has a circular groove section, which has a prescribed width and formed on the entire outer circumferential faces of the rotary valve, and a wide groove section, which is wider than the circular groove section, and the wide groove sections of the rotary valves are point-symmetrically formed with respect to the axis of the shaft.

With this structure, number of parts constituting the rotary valve can be reduced, and the rotary valve can be compactly attached to the case. Since each of the passage grooves has the circular groove section, which has the prescribed width and formed on the entire outer circumferential faces of the rotary valve, and the wide groove section, which is wider than the circular groove section, and the wide groove sections of the rotary valves are point-symmetrically formed with respect to the axis of the shaft, the switching action between the suction and the discharge through the wide groove sections can be precisely performed.

Preferably, the rotary valve for suction and the rotary valve for discharge are integrated with one of the first and second balance weights, which are rotatably held by the case, and a pair of the passage grooves, each of which has a circular groove section having a prescribed width and being formed on the entire outer circumferential faces of the rotary valve, and a wide groove section, which is wider than the circular groove section, and the wide groove sections of the passage grooves are alternately formed, in the axial direction, in a mutually complementary manner.

With this structure, a pair of the passage grooves, each of which has the circular groove section having the prescribed width and being formed on the entire outer circumferential faces of the rotary valve, and the wide groove section, which is wider than the circular groove section, and the wide groove sections of the passage grooves are alternately formed, in the axial direction, in the mutually complementary manner, so that the balance of the balance weights can be easily achieved, vibration caused by the rotation can be restrained and noise can be reduced.

Effects of the Invention

By employing the fluid rotary machine of the present invention, operational loss can be reduced, footprint can be decreased by reducing number of parts and simplifying valve structure as well as by reducing the externally coupled pipes used for the suction and the discharge of the fluid.

BRIEF DESCRIPTION OF THE DRAWINGS

FIGS. 6A-5D are a front view, a sectional view taken along a line A-A, a perspective view and a vertical sectional view of the first rotary valve;

FIGS. 7A-7E are a perspective view, a front view, a right side view, a sectional view taken along a line B-B and a sectional view taken along a line C-C of cylinders assembled in a case;

FIGS. 10A-10D are schematic views showing transition between the suction and the discharge of the first and second rotary valves according to positions of pistons;

FIGS. 13A-13D are explanation view showing an example in which sealing members are provided between the case and fluid paths of cylinders;

FIGS. 20A-20E are a front view, a left side view, a rear view, a right side view and a perspective view of the first rotary valve;

FIGS. 21A-21H are a sectional view of the fluid rotary machine in which the rotary valves are separated from the balance weights, a perspective view, a front view, a left side view, a sectional view taken along a line K-K, an exploded front view, an exploded left side view and an exploded perspective view of the rotary valve;

EMBODIMENTS OF THE INVENTION

Preferred embodiments of the present invention will now be described in detail with reference to the accompanying drawings. Firstly, an embodiment of the fluid rotary machine for a non-compressed fluid, e.g., fluid pump, will be explained with reference to FIGS. 1-15A and 15B.

Figure 1:
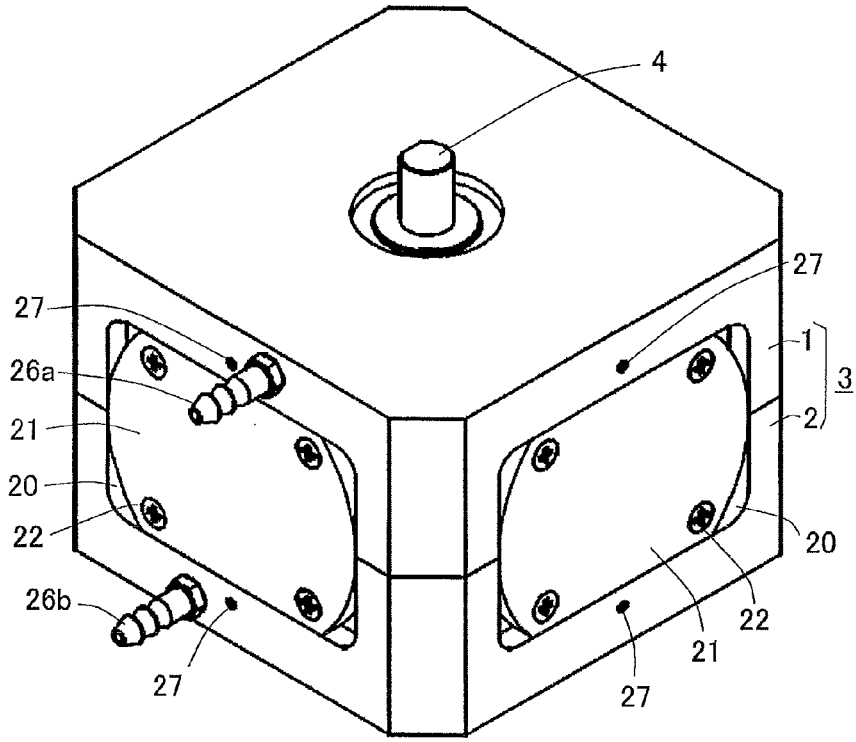
FIG. 1 A perspective view of a fluid rotary machine.
Figure 2:
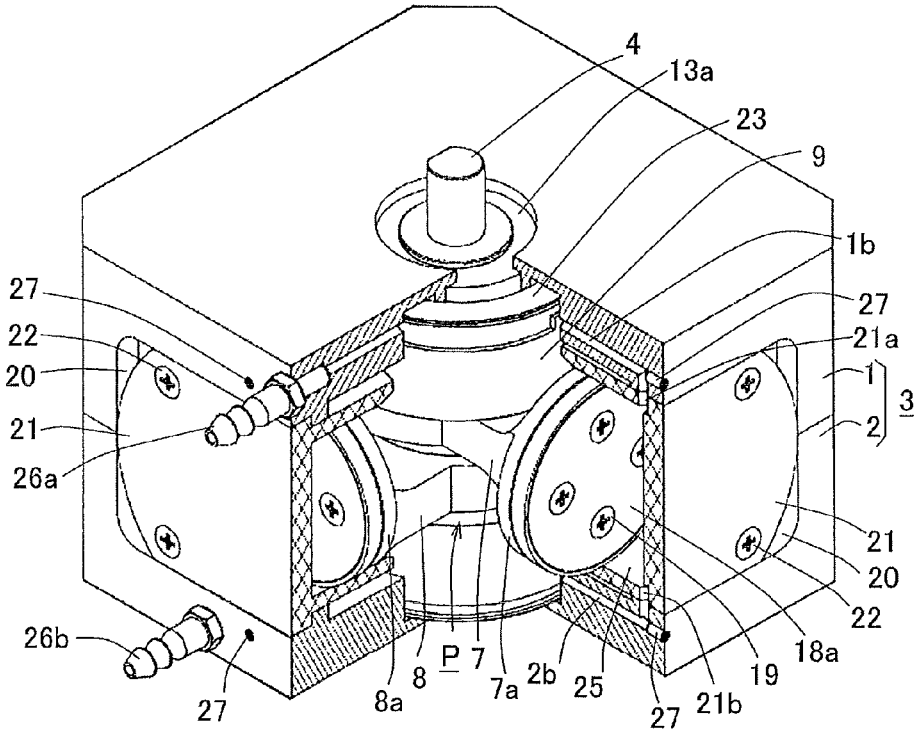
FIG. 2 A partially cutaway view of the fluid rotary machine shown in FIG. 1.

In FIG. 1, a case 3 is constituted by a first case part 1 and a second case part 2, and a shaft (input-output shaft) 4 is rotatably held by the case 3. The first case part 1 and the second case part 2 are integrated by bolts 3*a*, which are provided to four corners (see FIG. 12). As shown in FIG. 2, an eccentric tube body 6 (see FIG. 3), which can be rotated about a first crank shaft 5, is accommodated in the case 3, and a first double-headed piston 7 and a second double-headed piston 8 (hereinafter referred to as "piston composite body P", see FIG. 2), which are attached to the eccentric tube body 6 with bearings and disposed in a crisscross arrangement, are rotatably accommodated in the case. Details will be concretely explained.

Figure 3:
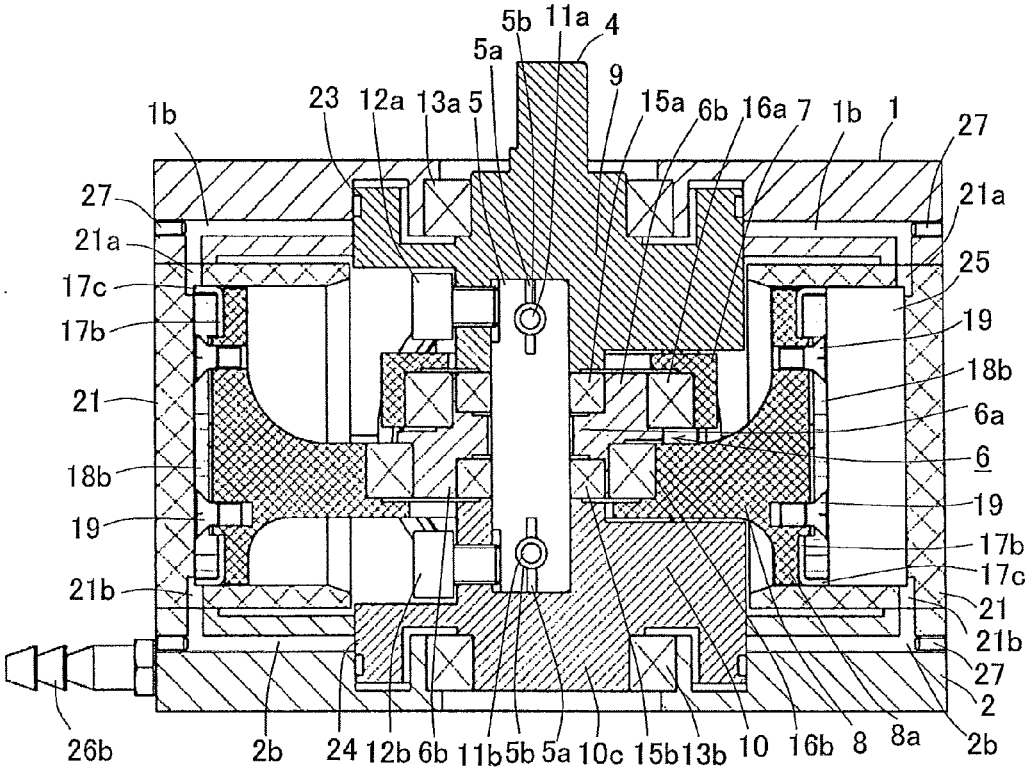
FIG. 3 A vertical sectional view of the fluid rotary machine shown in FIG. 1.

In FIG. 3, a first crank shaft 5 is eccentrically coupled to the shaft 4. In the present embodiment, the shaft 4 is integrated with a first balance weight 9. Note that, the shaft may be formed in a second balance weight 10, too. The first and second balance weights 9 and 10 are respectively inserted and incorporated into both end parts of the first crank shaft 5. Slits 5*a* are respectively formed in the both end parts of the first crank shaft 5. In each of the slits 5*a*, a pin hole 5*b* are formed in the direction perpendicular to an axis of the first crank shaft 5. A diameter of the pin hole 5*b* is greater than a width of the slit 5*a*, and the pin hole 5*b* corresponds to a part of the slit 5*a*. The first and second balance weights 9 and 10 are respectively fitted in the both end parts of the first crank shaft 5 in a state where pin holes 9*a* and 10*a* (see FIGS. 4B and 5B) correspond to the pin holes 5*b*.

Figure 6B:
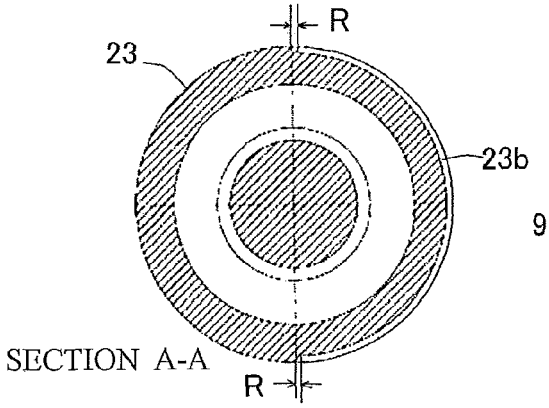
Figure 6C:
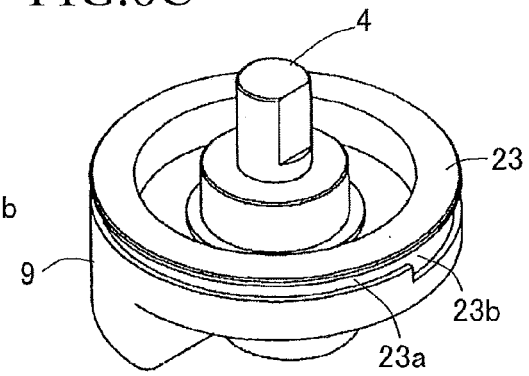
Figure 6A:
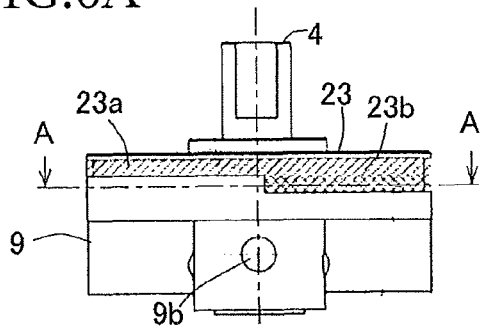
Figure 6D:
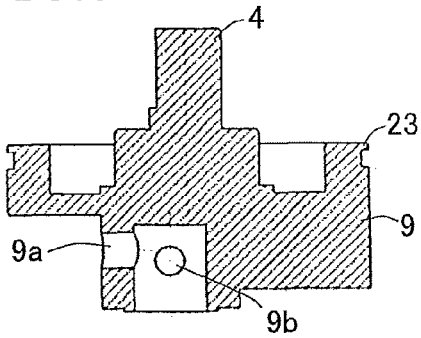
Figure 7A:
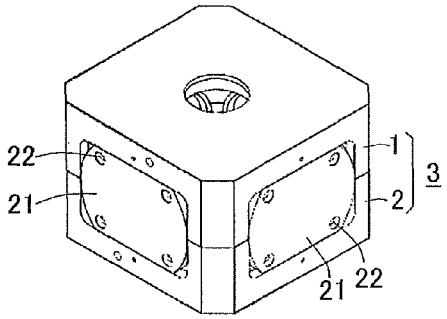
Figure 7B:
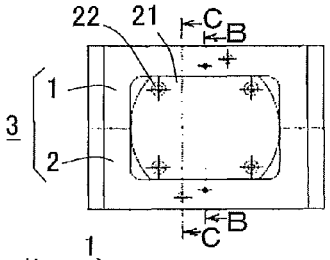
Figure 7C:
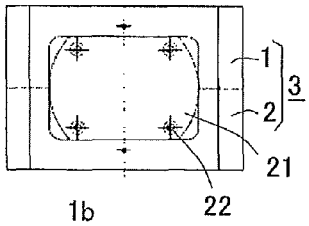
Figure 7C:
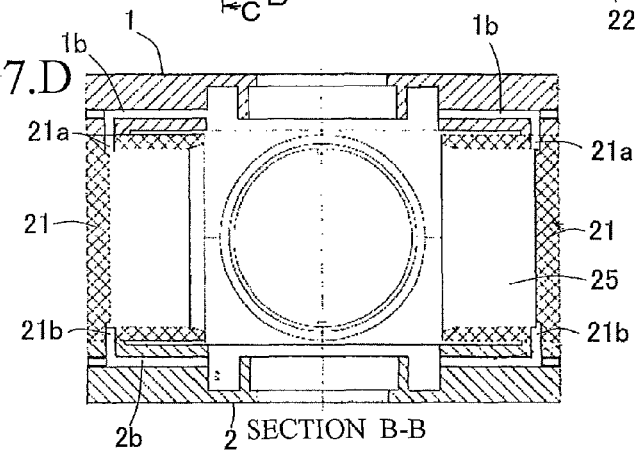
Figure 7E:
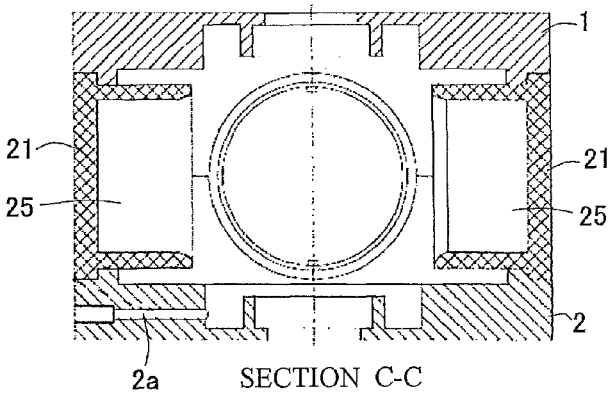
Figure 8A:
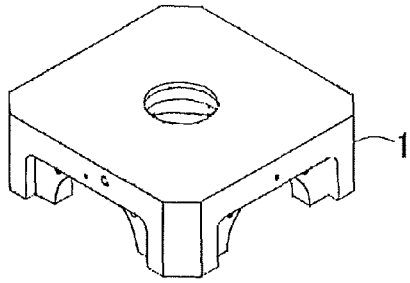
FIGS. 8A-8F are a perspective view, a front view, a sectional view taken along a line D-D, a sectional view taken along a line E-E, a sectional view taken along a line F-F and a sectional view taken along a line G-G of a first case part.
Figure 8B:
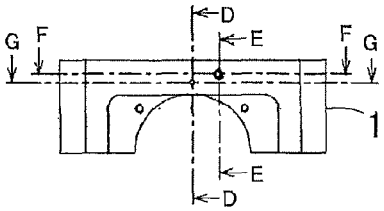
Figure 8C:
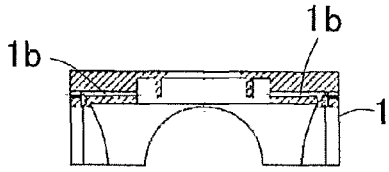
Figure 8D:
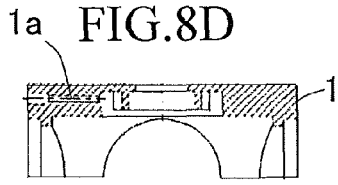
Figure 8E:
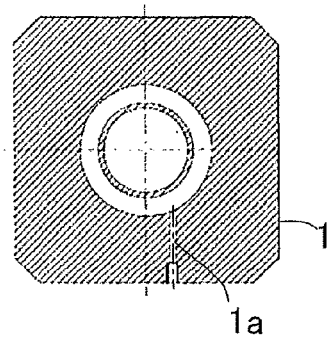
Figure 8F:
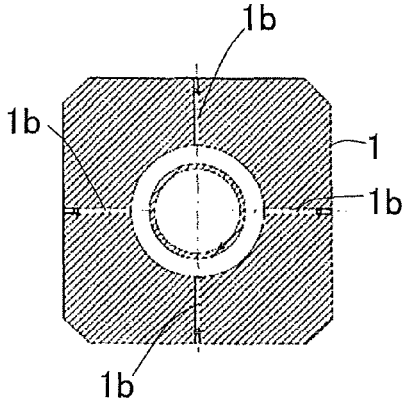

In FIGS. 6A and 6D, bolt holes 9*b* and 10*b* (not shown) and the pin holes 9*a* and 10*a* are respectively formed in shaft sections of the first and second balance weights 9 and 10. The pin holes 9*a* and 10*a* are corresponded to the pin holes 5*b* (see FIG. 3) of the first crank shaft 5 so as to communicate to each other, the first and second balance weights 9 and 10 are fitted into first crank shaft 5, a pin 11*a* (see FIG. 3) is fitted into the pin holes 9*a* and 5*b*, which are communicated to each other, and a pin 11*b* (see FIG. 3) is fitted into the pin holes 10*a* and 5*b*, which are communicated to each other. Further, bolts 12*a* and 12*b* are respectively fitted into the bolt holes 9*b* and 10*b* (not shown), and then widths of the slits 6*a* and the pin holes 5*b* are narrowed, so that the pins 11*a* and 11*b* are retained and the first and second balance weights 9 and 10 are respectively integrated with the both end parts of the first crank shaft 5 (see FIGS. 4A and 4B). Therefore, assembling accuracy of the first and second balance weights 9 and 10 coupled to the first crank shaft 5, in the direction perpendicular to the axis, can be improved.

In FIG. 3, the shaft 4 integrated with the first balance weight 9 is rotatably held by a first bearing 13*a* provided between the first balance weight 9 and the first case part 1; a shaft section 10*c*, which is disposed coaxially with the shaft 4 is rotatably held by a second bearing 13*b* provided between the second balance weight 10 and the second case part 2. The first and second balance weights 9 and 10 are fan-shaped blocks (see FIG. 4B) and provided to achieve a rotational balance between rotational parts including the first crank shaft 5 and the piston composite body P, which are attached around the shaft 4.

In case that the shaft 4 is integrated with at least one of the first and second balance weights 9 and 10, number of parts can be reduced, and the first crank shaft 5 can be compactly attached, around the shaft 4, in the axial and radial directions by adjusting a length of a first imaginary crank arm, which connects the shaft 4 to the first crank shaft 5, according to a turning radius r of the first and second balance weights 9 and 10.

As shown in FIG. 3, the first and second double-headed pistons 7 and 8 are disposed in the crisscross arrangement and attached to the eccentric tube body 6, which is rotated about the first crank shaft 5. Concretely, the eccentric tube body 6 includes a first tube body 6*a*, through which the first crank shaft 5 acting as the rotational center is pierced, and second tube bodies 6*b*, which are respectively extended from both axial ends of the first tube body 6*a*. The first crank shaft 5 is fitted in the first tube body 6*a* and acts as the rotational center of the eccentric tube body 6. Further, axes of the second tube bodies 6*b* correspond to that of a second imaginary crank shaft (the axis of the second tube body 6*b*, not shown), which is eccentrically disposed with respect to the axis of the first crank shaft 5 (the first tube body 6*a*).

As shown in FIG. 3, inner bearings 15*a* and 15*b* are held inside the second tube bodies 6*b*, and outer bearings 16*a* and 16*b* are held outside. The inner bearings 15*a* and 15*b* rotatably hold the first crank shaft 5. The first and second double-headed pistons 7 and 8 are rotatably held in a state where the pistons are fitted in the second tube bodies 6*b*, with the outer bearings 16*a* and 16*b*, in the crisscross arrangement.

With this structure, a length of a second imaginary crank arm, which connects the first crank shaft 5 to the second imaginary crank shaft, is adjusted by changing the rotational radius r of the second tube bodies 6*b*, so that the piston composite body P, which includes the eccentric tube body 6, can be compactly attached, in the axial and radial directions, on the first crank shaft 5.

In FIG. 3, ring-shaped seal cups 17*a* and 17*b* and seal cup retainers 18*a* and 18*b* are attached, by bolts 19, to first piston heads 7*a* and second piston heads 8*a*, which are provided to the axial ends of the first and second double-headed pistons 7 and 8. The seal cups 17*a* and 17*b* are composed of an oil-free material (e.g., PEEK (polyether ether ketone)). Extended sections 17*c* are extended, in the moving directions of the pistons, from outer edges of the seal cups 17*a* and 17*b*. In the present fluid rotary machine, the extended sections 17*c* are outwardly extended in the moving directions of the pistons.

In FIGS. 1 and 2, cylinders 21 are attached to opening sections 20 formed in side faces (four side faces) of the case 3 (the first and second case parts 1 and 2) by bolts 22. As shown in FIG. 2, by the seal cups 17*a* and 17*b* (the extended sections 17*c*), the double-headed pistons 7 and 8 can slide, on inner faces of the cylinders 21, with keeping sealing property. Note that, in comparison with other rotational parts, the seal cups 17*a* and 17*b* are light and their rotating masses can be ignored, so achieving balance by the first and second balance weights 9 and 10 is not badly influenced.

In FIG. 3, a first rotary valve (discharge valve) 23 and a second rotary valve (suction valve) 24 for switching between the suction and discharge operations of the fluid for each cylinder chamber are incorporated into the case 3, and they are coaxial and integrally rotatable with the shaft 4.

Figure 4A:
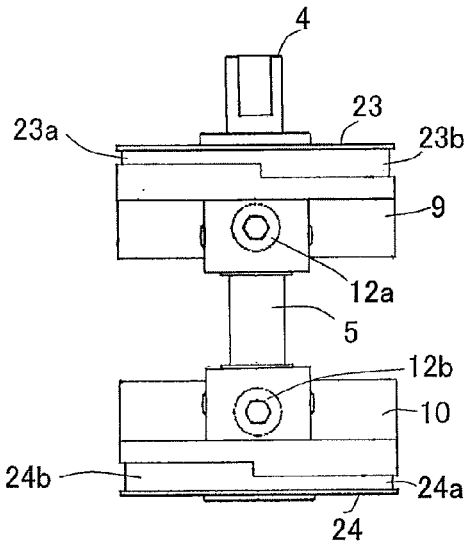
FIGS. 4A and 4B are a front view and a perspective view of first and second rotary valves.
Figure 4B:
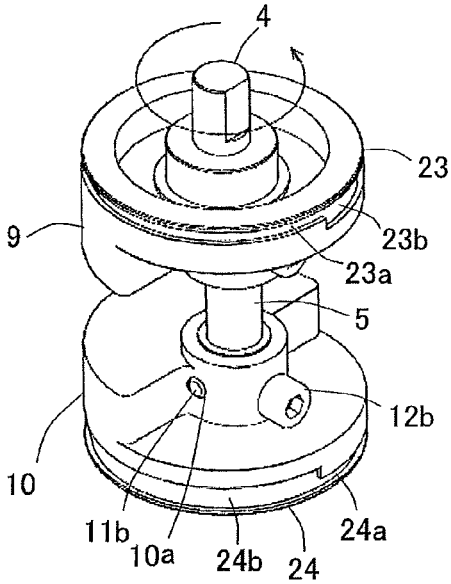

Concretely, as shown in FIGS. 4A and 4B, the first rotary valve 23 is integrated with the first balance weight 9, and the second rotary valve 24 is integrated with the second balance weight 10. The first rotary valve 23 and the second rotary valve 24 are respectively formed at the both ends of the first crank shaft 5. Since the first rotary valve 23 is integrated with the first balance weight 9 and the second rotary valve 24 is integrated with the second balance weight 10, number of parts can be reduced and they can be compactly incorporated into the case 3.

Figure 5C:
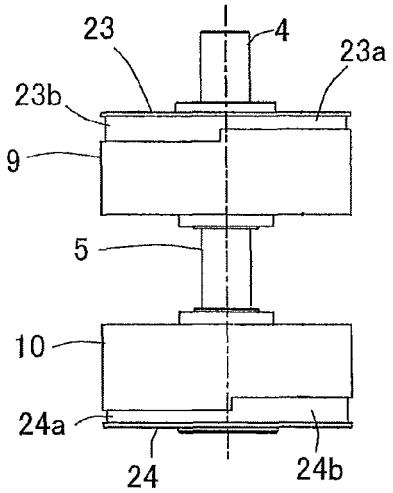
FIGS. 5A-5C are a front view, a left side view and a rear view of the valves shown in FIGS. 4A and 4B.
Figure 5B:
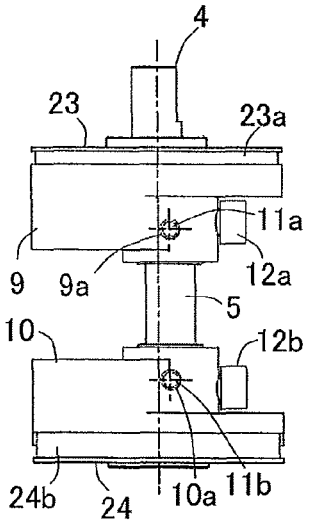
Figure 5A:
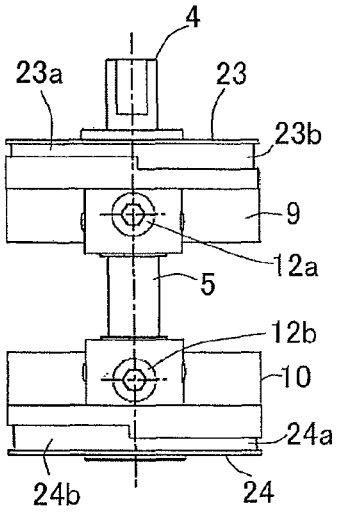

The first rotary valve 23 and the second rotary valve 24 respectively have passage grooves, which are formed in the circumferential direction and whose width is varied. Concretely, circular groove sections 23*a* and 24*a* having a prescribed width (see FIG. 5B) are formed on entire outer circumferential faces of the valves, and wide groove sections 23*b* and 24*b*, whose width is wider than that of the circular groove sections, are partially formed. As shown in FIGS. 5A and 5C, the wide groove sections 23*b* and 24*b* are point-symmetrically formed with respect to the axis of the shaft 4. Therefore, switching between the sucking operation and the discharge operation through the wide groove sections 23*b* and 24*b* can be correctly performed.

First fluid paths 1*a* and 2*a* (see FIGS. 7A, 7B, 7E, 8A, 8B, 8C and 8E), which communicate the circular groove sections 23*a* and 24*a* to external paths, and second fluid paths 1*b* and 2*b* (see FIGS. 3, 7A, 7B, 7C, 7D, 8A, 8B, 8D and 8F), which communicate the wide groove sections 23*b* and 24*b* to the cylinder chambers 25, are formed in the first case part 1 and the second case part 2. The second fluid paths 1*b* and 2*b* are communicated to the cylinder chambers 25 via communication holes 21*a* and 21*b*.

In FIGS. 6A and 6D, the circular groove sections 23*a* and 24*a* are circularly formed on the entire outer circumferential faces of the first rotary valve 23 and the second rotary valve 24; as shown in FIG. 6B, the wide groove sections 23*b* and 24*b* are formed in a range whose circular length is obtained by subtracting a width R half of the first and the second fluid paths from the both ends of a perimeter of an arc whose center angle is 180 degrees.

For example, in case that the first fluid paths are used for sucking the fluid from and discharging the same to the external fluid paths and the second fluid paths are communicated to the cylinder chambers as common paths, pipes or tubes can be omitted and the piping structure can be simplified. Therefore, as shown in FIG. 2, number of required valves, which is eight for the conventional four-head fluid rotary machine, can be minimized to two.

Figure 12:
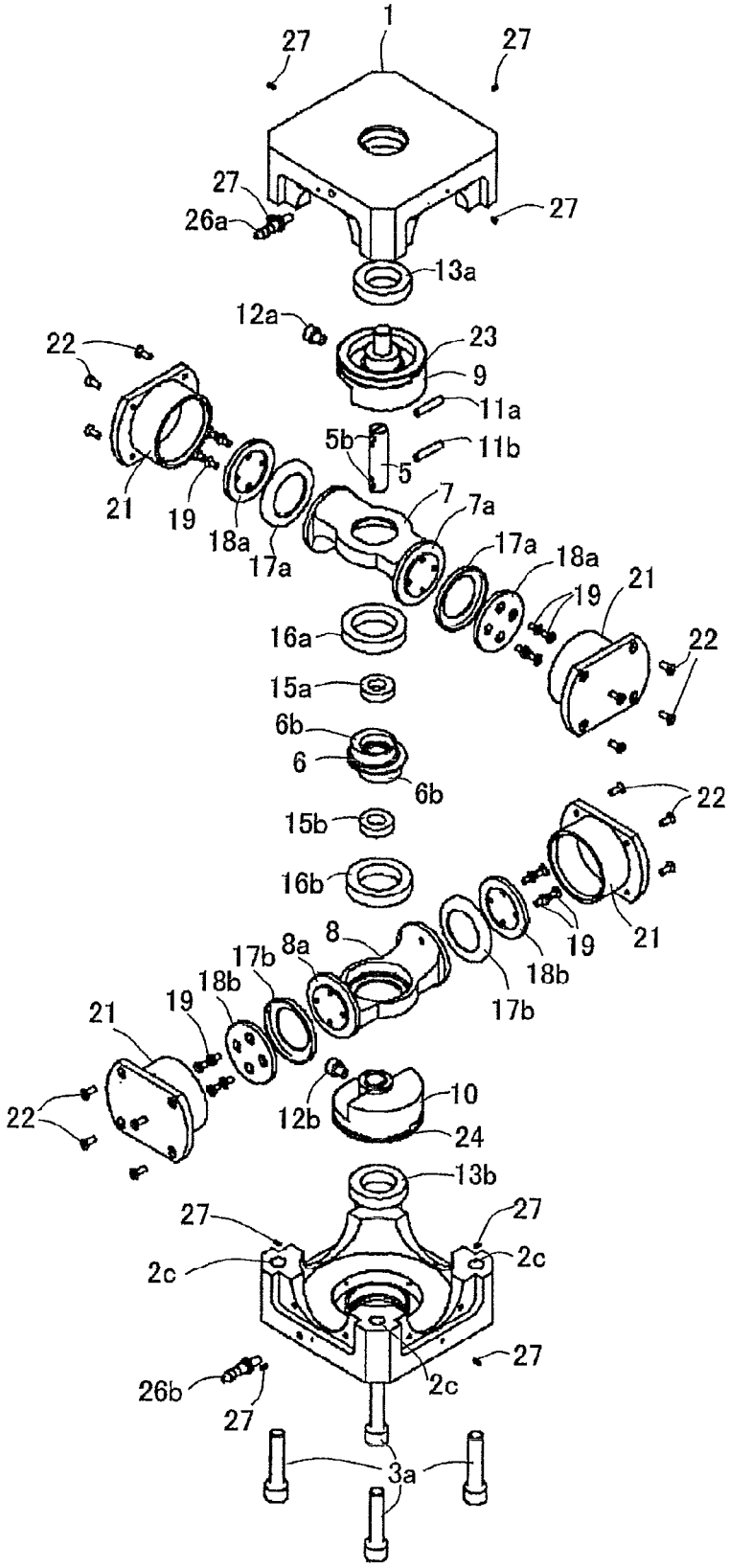
FIG. 12 An exploded perspective view of the fluid rotary machine.

Next, a structure of an example of the fluid rotary machine will be explained with reference to FIG. 12.

The inner bearings 15*a* and 15*b* are incorporated in the second tube bodies 6*b* of the eccentric tube body 6. The first crank shaft 5 is fitted into a center hole of the first tube body 6*a* in which the inner bearings have been incorporated (see FIG. 3). The first and second double-headed pistons 7 and 8, in which the seal cups 17*a* and 17*b* and the seal cup retainers 18*a* and 18*b* have been fixed to the first and second piston heads 7*a* and 8*a*, are fitted outside of the second tube bodies 6*b*, with the outer bearings 16*a* and 16*b*, in the crisscross arrangement.

Next, the first and second balance weights 9 and 10 are respectively fitted to the both end parts of the first crank shaft 5, the pins 11*a* and 11*b* are fitted into the pin holes 5*b*, and the bolts 12*a* and 12*b* are tightly screwed, so that the first and second balance weights 9 and 10 (the first rotary valve 23 and the second rotary valve 24) can be integrated with the first crank shaft 5. The first bearing 13*a* and the second bearing 13*b* are respectively fitted to bearing holders of the first and second balance weights 9 and 10. Then, the first case part 1 and the second case part 2 are combined. Therefore, the first crank shaft 5, the first and second balance weights 9 and 10 and the piston composite body P (see FIG. 2) are accommodated in the case 3 (see FIG. 1). Bolt holes (not shown) of the first case part 1 are corresponded to through-holes 2*c* of the second case part 2, and the bolts 3*a* are screwed to assemble the case 3 (see FIG. 1). Finally, the cylinders 21 are fitted into the opening sections 20 (see FIG. 2) formed in the side faces (four faces) of the case 3, and the first piston heads 7*a* and the second piston heads 8*a* are slidably fitted into the opening sections (see FIG. 2), so that the fluid rotary machine is completed. Tube connectors 26*a* and 26*b* are respectively provided to a discharge port of the first case part 1 and a suction port of the second case part 2. Eight closing screws 27 are screwed into holes communicated to the second fluid path 1*b* of the first case part 1 and the second fluid path 2*b* of the second case part 2 so as to close the holes.

In the above described fluid rotary machine, a first rotational balance relating to the first and second double-headed pistons 7 and 8 around the second imaginary crank shafts (not shown), a second rotational balance relating to the piston composite body P around the first crank shaft 5 and a third rotational balance relating to the first crank shaft 5 and the piston composite body P around the shaft 4 are achieved by the first and second balance weights 9 and 10.

With this structure, even if the first and second double-headed pistons 7 and 8 incorporated in the second tube bodies 6*b* are linearly reciprocated, in the radial direction of the rolling circle of the second imaginary crank shaft, which has a radius 2r and which is centered at shaft 4 (along a hypocycloid track), by the rotation of the first crank shaft 5 about the shaft 4 and the rotation of the piston composite body P about the first crank shaft 5, the balance including mass eccentricity caused by the linear reciprocation of the first and second double-headed pistons 7 and 8 can be achieved, so that vibration and noise caused by the rotation can be reduced. In comparison with the conventional reciprocating piston heads, the first and second double-headed pistons 7 and 8 are capable of reducing mechanical loss caused by the reciprocation, improving energy conversion efficiency and omitting vibration-proofing members, e.g., dampers, due to the reduction of the vibration caused by the rotation.

Open and close operations of the first and second rotary valves 23 and 24 will be explained with reference to FIGS. 9A-9E, in each of which the sucking action and the discharging action in one of the cylinder chambers 25 (right side chamber) of the first double-headed piston 7 and one of the cylinder chambers (near side chamber) of the second double-headed piston 8.

Figure 9A:
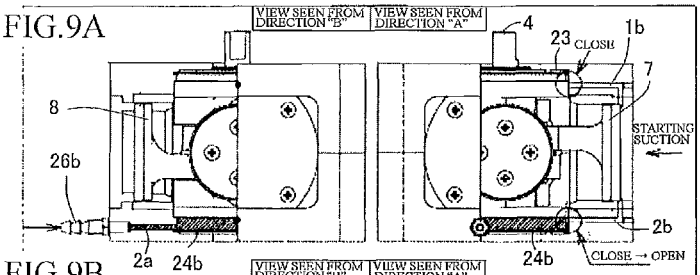
FIGS. 9A-9E are explanation views explaining switching action between sucking a fluid and discharging the fluid performed by rotation of the rotary valve.
Figure 9B:
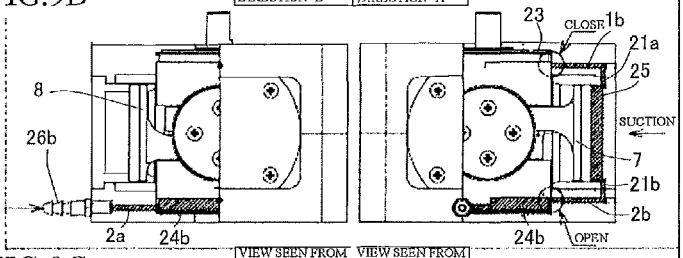
Figure 9B:
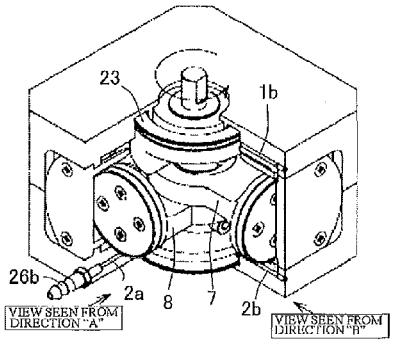

In FIG. 9A, in the first rotary valve 23, the circular groove section 23*a* and the first fluid path 1*a* are closed; in the second rotary valve 24, the wide groove section 24*b* of the circular groove section 24*a* is move to face the second fluid path 2*b* so that the valve is switched from the closed state to the open state. Therefore, as shown in FIG. 9B, the fluid is sucked into the cylinder chamber 25 via the tube connector 26*b*, the second fluid path 2*a*, the wide groove section 24*b* and the circular groove section 24*a*, and the fluid is sucked into the cylinder chamber 25 via the wide groove section 24*b*, the second fluid path 2*b* and the communication hole 21*b*.

Figure 9C:
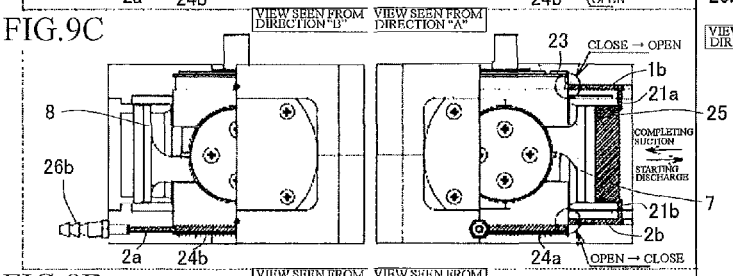
Figure 9D:
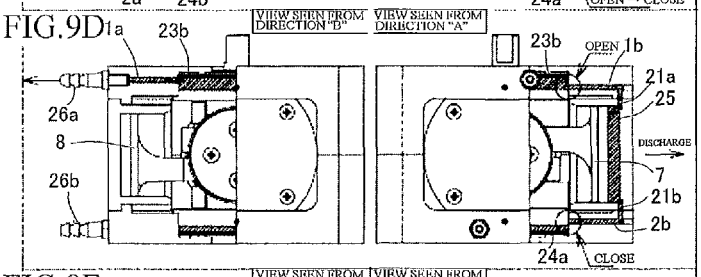
Figure 9D:
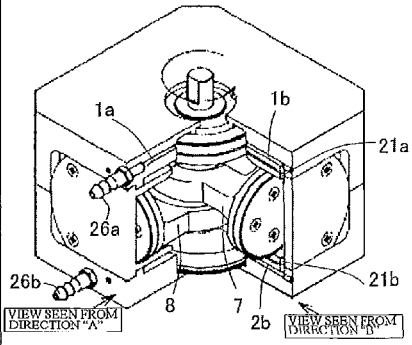

In FIG. 9C, when sucking the fluid into the cylinder chamber 25 is completed, the circular groove section 24*a* of the second rotary valve 24 is turned to the position of the second fluid path 2*b* so as to close the valve, so that the wide groove section 23*b* of the circular groove section 23*a* of the first rotary valve 23 is moved to face the first fluid path 1*b* and the valve is switched from the closed state to the open state. Therefore, as shown in FIG. 9D, the fluid is discharged from the cylinder chamber 25 via the communication hole 2*a*, the first fluid path 1*b*, the wide groove section 23*b*, the circular groove section 23*a*, the first fluid path 1*a* and the tube connector 26*a*.

Figure 9E:
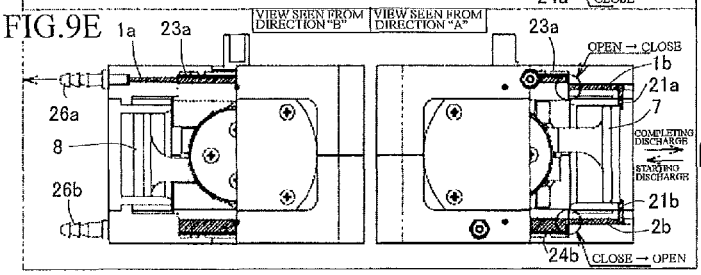

In FIG. 9E, when discharging the fluid from the cylinder chamber 25 is completed, the circular groove section 23*a* of the first rotary valve 23 is turned to the position of the first fluid path 1*b* so as to close the valve, so that the wide groove section 24*b* of the circular groove section 24*a* of the second rotary valve 24 is moved to face the second fluid path 2*b*, the valve is switched from the closed state to the open state and the sucking operation is started.

As described above, the first rotary valve 23 and the second rotary valve 24 alternately perform the sucking operation and the discharge operation for the cylinder chamber 25 only while the wide groove sections 3*b* and 24*b* face the first and second fluid paths 1*b* and 2*b*.

FIGS. 10A-10D and 11A-11D are explanation views showing positions of the first and second double-headed pistons 7 and 8 and actions of the first and second rotary valves 23 and 24.

In each of the drawings, an upper part shows the action of the first rotary valve 23, a middle part shows the positions of the pistons (the position of the first double-headed piston 7 is shown in the horizontal direction; the position of the second double-headed piston 8 is shown in the vertical direction), and a lower part shows the action of the second rotary valve 24. In the drawings, the first and second rotary valves 23 and 24 are turned 45 degrees in series. Four cylinder chambers 25*a*-25*d* are arranged in the counterclockwise direction from the right end.

Figures 10A, 10C, 10D:
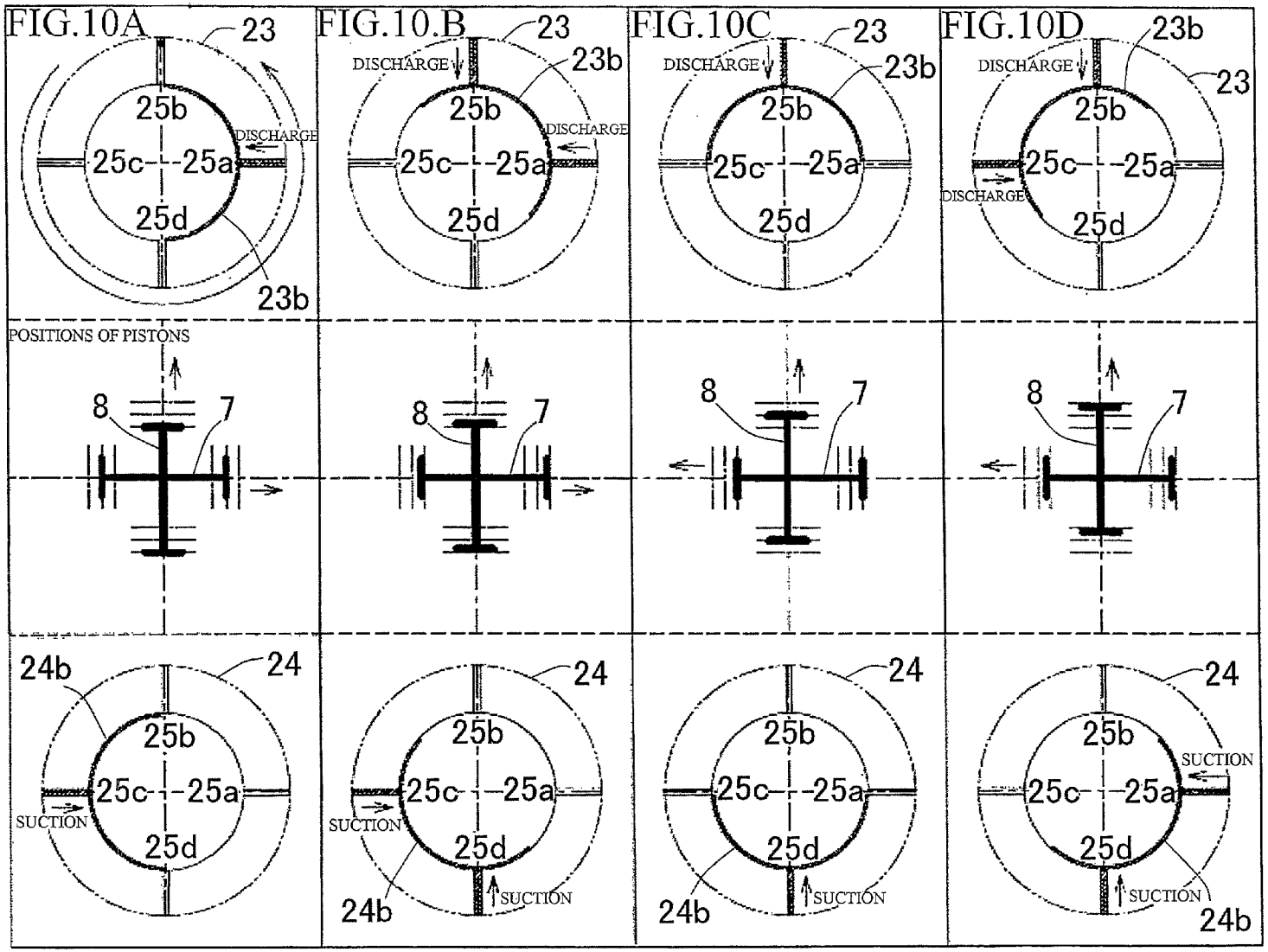

In FIG. 10A, the first double-headed piston 7 is in the middle of moving rightward, and the second double-headed piston 8 is located at the lower end. In this state, the fluid is discharged from the cylinder chamber 25*a* via the first rotary valve 23, and the fluid is sucked into the cylinder chamber 25*c* via the second rotary valve 24.

In FIG. 10B, the first double-headed piston 7 is located just short of the right end, and the second double-headed piston 8 has just started to move upward. In this state, the fluid is discharged from the cylinder chambers 25*a* and 25*b* via the first rotary valve 23, and the fluid is sucked into the cylinder chambers 25*c* and 25*d* via the second rotary valve 24.

In FIG. 10C, the first double-headed piston 7 has just started to move leftward, and the second double-headed piston 8 is in the middle of moving upward. In this state, the fluid is discharged from the cylinder chamber 25*b* via the first rotary valve 23, and the fluid is sucked into the cylinder chamber 25*d* via the second rotary valve 24.

In FIG. 10D, the first double-headed piston 7 is located at the right end, and the second double-headed piston 8 is located just short of the upper end. In this state, the fluid is discharged from the cylinder chambers 25*b* and 25*c* via the first rotary valve 23, and the fluid is sucked into the cylinder chambers 25*d* and 25*a* via the second rotary valve 24.

Figures 11A, 11B, 11C, 11D:
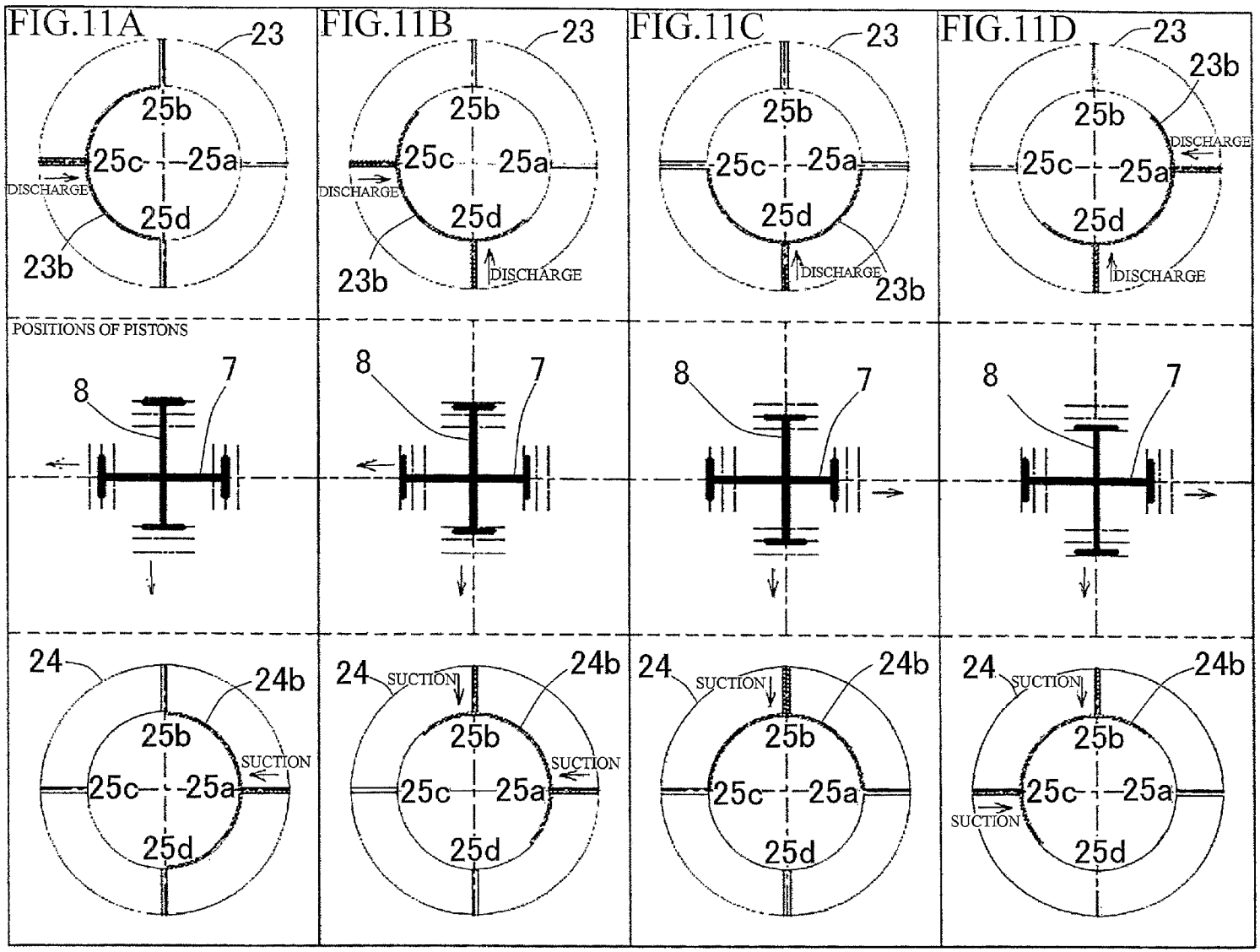
FIGS. 11A-11D are schematic views showing transition between the suction and the discharge of the first and second rotary valves according to positions of the pistons.

In FIG. 11A, the first double-headed piston 7 is in the middle of moving leftward, and the second double-headed piston 8 is located at the upper end. In this state, the fluid is discharged from the cylinder chamber 25*c* via the first rotary valve 23, and the fluid is sucked into the cylinder chamber 25*a* via the second rotary valve 24.

In FIG. 11B, the first double-headed piston 7 is located just short of the left end, and the second double-headed piston 8 has just started to move downward. In this state, the fluid is discharged from the cylinder chambers 25*c* and 25*d* via the first rotary valve 23, and the fluid is sucked into the cylinder chambers 25*a* and 25*b* via the second rotary valve 24.

In FIG. 11C, the first double-headed piston 7 is located at the left end, and the second double-headed piston 8 is in the middle of moving downward. In this state, the fluid is discharged from the cylinder chamber 25*d* via the first rotary valve 23, and the fluid is sucked into the cylinder chamber 25*b* via the second rotary valve 24.

In FIG. 11D, the first double-headed piston 7 has just started to move rightward, and the second double-headed piston 8 is located just short of the lower end. In this state, the fluid is discharged from the cylinder chambers 25*d* and 25*a* via the first rotary valve 23, and the fluid is sucked into the cylinder chambers 25*b* and 25*c* via the second rotary valve 24.

Then, the state is returned to the state shown in FIG. 10A, and the above described sucking and discharging operations are repeated. Note that, the first rotary valve 23 is used for suction and the second rotary valve 24 is used for discharge, but the first rotary valve 23 may be used for discharge and the second rotary valve 24 may be used for suction.

As described above, the first and second double-headed pistons 7 and 8 are linearly reciprocated by the rotation of the shaft 4, and the switching action between the sucking and discharging operations in the cylinder chambers 25*a*-25*d* are performed by the first and second rotary valves 23 and 24, which are incorporated into the case 3 to be coaxial and rotatable with the shaft 4. Therefore, tube connectors communicated to the cylinder chambers 25*a*-25*d* can be reduced to two, i.e., the tube connectors 26*a* and 26*b*, so that footprint of the fluid rotary machine can be decreased by reducing number of parts and simplifying the valve structure as well as by reducing externally coupled pipes used for suction and discharge of the fluid.

For example, in case of a pump for a gas-liquid mixing fluid used for freezing, connecting sections between fluid paths must be highly sealed. Thus, it is preferable to provide O-rigs 28 (sealing members) between the case 3 and the cylinders 21 as shown in FIGS. 13A-13D. In FIG. 13B, the O-rings 28 are respectively provided to the connecting section between the second fluid path 1*b* and the communication hole 21*a* of the cylinder 21 and the connecting section between the second fluid path 2*b* and the communication hole 21*b* of the cylinder 21. Further, the O-ring 28 may be provided in a concave section 29 as shown in FIG. 13D, and a partition wall 30 may be formed in the concave section 29 as shown in FIG. 13C.

The O-rings 28 may be provided between the first and second rotary valves 23 and 24 and the first and second case parts 1 and 2.

Figure 14A:
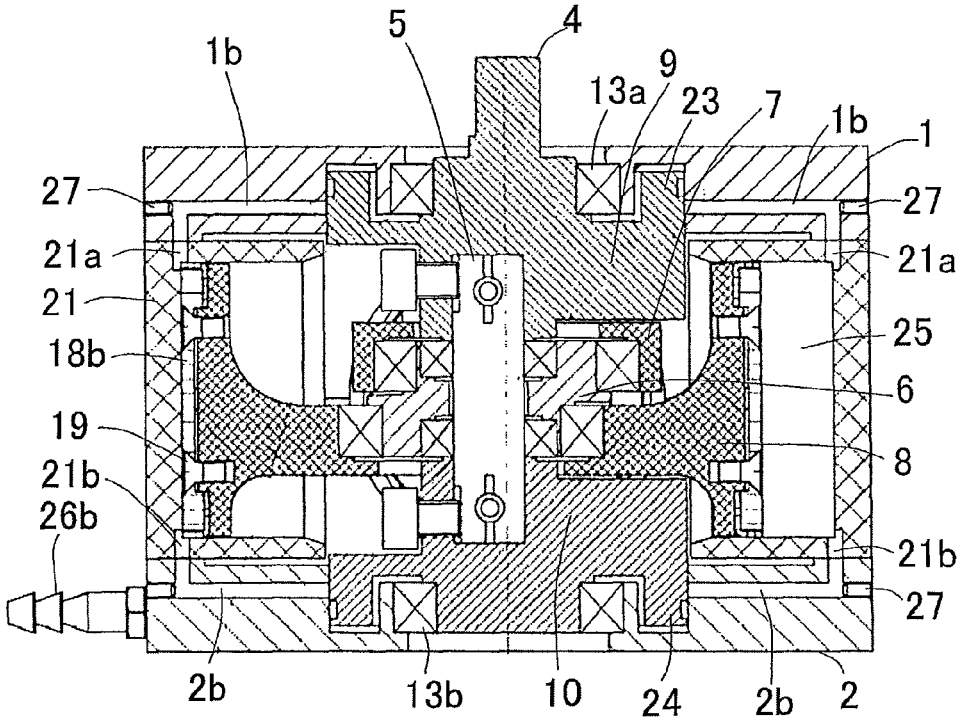
FIGS. 14A and 14B are a vertical sectional view of the fluid rotary machine shown in FIG. 1 and a partial sectional view of a sealing structure between the case and the rotary valves.
Figure 14B:
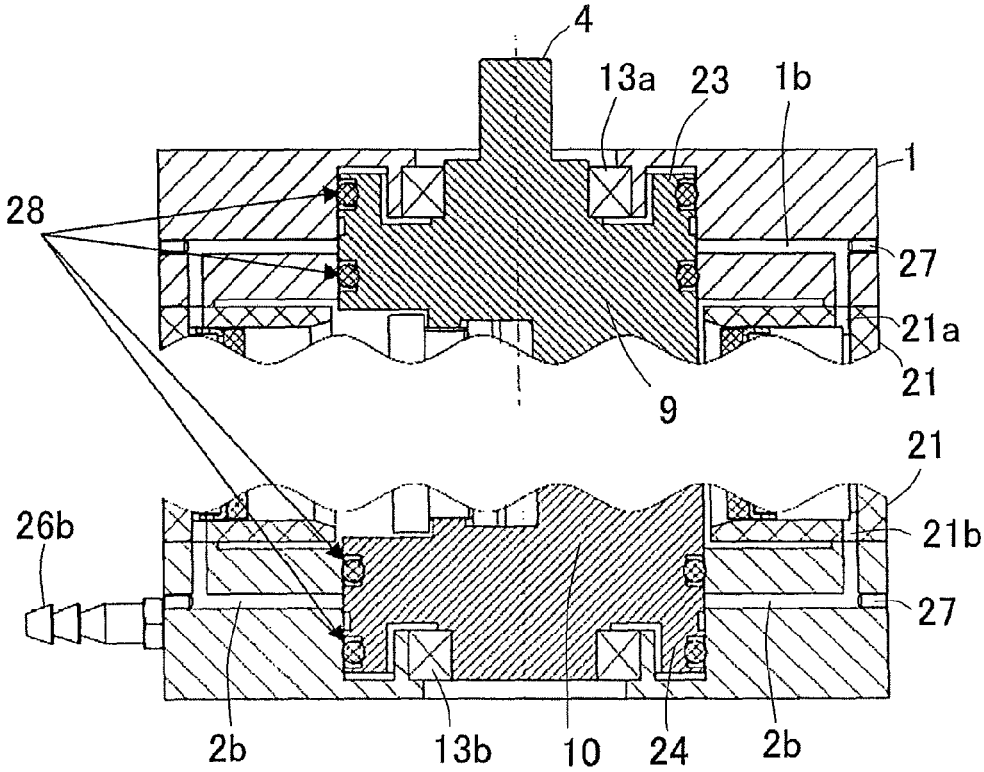

In FIGS. 14A and 14B, FIG. 14B is an enlarged sectional view of the fluid path connecting sections between the first and second rotary valves 23 and 24 and the first and second case parts 1 and 2. Axial thicknesses of the first and second rotary valves 23 and 24 may be increased so as to provide the O-rings 28 to the connecting section between the passage groove (the circular groove section 23*a* and the wide groove section 23*b*) and the second fluid path 1*b* and the connecting section between the passage groove (the circular groove section 24*a* and the wide groove section 24*b*) and the second fluid path 2*b*.

In the above described fluid rotary machine, e.g., fluid pump, a non-compressed fluid is mainly used; in case of using a compressed fluid, e.g., air, gas, the compressed fluid can be discharged by narrowing groove angles of the wide groove sections 23*b* and 24*b* of the first and second rotary valves 23 and 24 in the circumferential directions. In case of discharging the high pressure fluid into a prescribed pressure tank, if a valve is opened from starting the discharge operation, the high pressure fluid counter-flows from the tank and loss of a discharge operation of a piston must be increased.

Figure 15A:
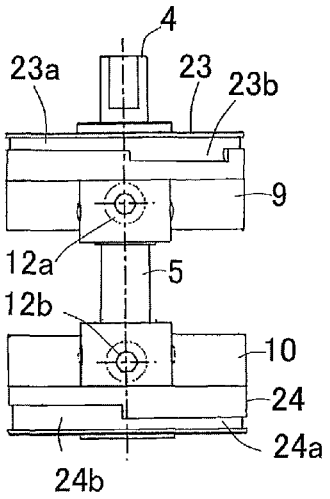
FIGS. 15A and 15B are a front view and a perspective view of another example of the first and second rotary valves for a compressed fluid.
Figure 15B:
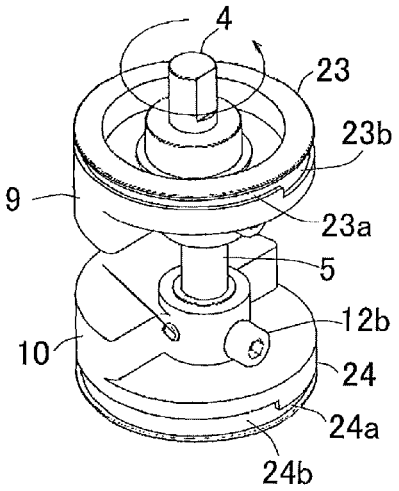

In this case too, as shown in FIGS. 15A and 15B, the first and second rotary valves 23 and 24 are respectively integrated with the first and second balance weights 9 and 10, which are respectively inserted and incorporated in the both end parts of the first crank shaft 5, and the circular groove sections 23*a* and 24*a* and the wide groove sections 23*b* and 24*b* are formed.

However, as shown in FIGS. 16A-16F, a forming range of the wide groove section 23*b*, with respect to the circular groove section 23*a* of the first rotary valve 23 for the discharge, is narrower than that of the wide groove section 24*b* of the second rotary valve 24 for the suction.

Figure 16E:
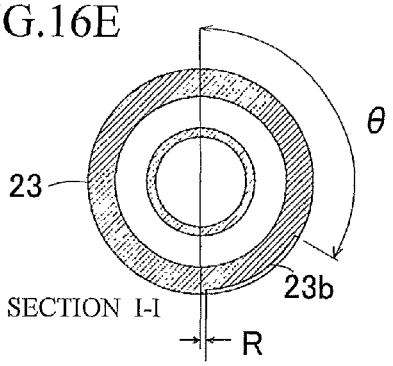
FIGS. 16A-16F are a front view, a left side view, a rear view, a right side view, a sectional view taken along a line I-I and a perspective view of the first rotary valve shown in FIGS. 15A and 15B.
Figure 16F:
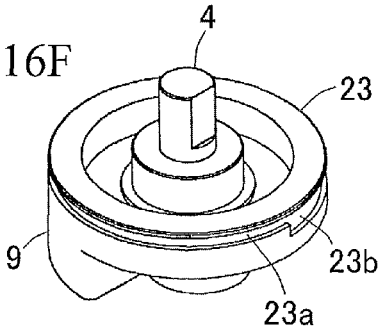
Figure 16C:
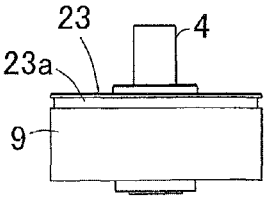
Figure 16B:
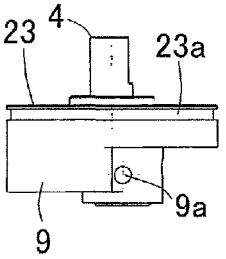
Figure 16A:
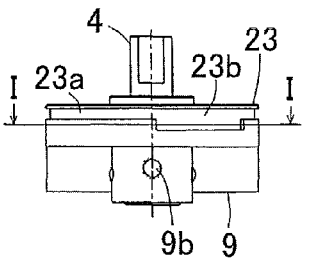
Figure 16D:
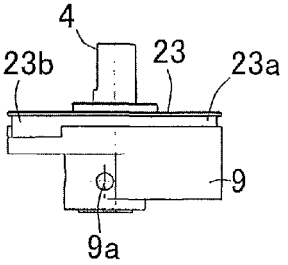

Concretely, as shown in FIG. 16E, the wide groove section is formed in a range which is defined by subtracting an optional angle θ and a radius R of the fluid path from 180° (i.e., 180°−θ−R), with respect to the circular groove section 23*a*, which is formed 360° on the outer circumferential face of the first rotary valve 23. With this structure, the fluid sucked into the cylinder chambers 25 is pressurized to a prescribed pressure and then discharged. In the present embodiment, the angle θ is 90° or more, and the angel of the wide groove section 23*b*, in the circumferential direction, is less than 90°.

FIGS. 17A-17D and 18A-18D are explanation views showing positions of the first and second double-headed pistons 7 and 8 and actions of the first and second rotary valves 23 and 24.

In each of the drawings, an upper part shows the action of the first rotary valve 23, a middle part shows the positions of the pistons (the position of the first double-headed piston 7 is shown in the horizontal direction; the position of the second double-headed piston 8 is shown in the vertical direction), and a lower part shows the action of the second rotary valve 24. In the drawings, the first and second rotary valves 23 and 24 are turned 45 degrees in series. Four cylinder chambers 25*a*-25*d* are arranged in the counterclockwise direction from the right end.

Figures 17A, 17B, 17C, 17D:
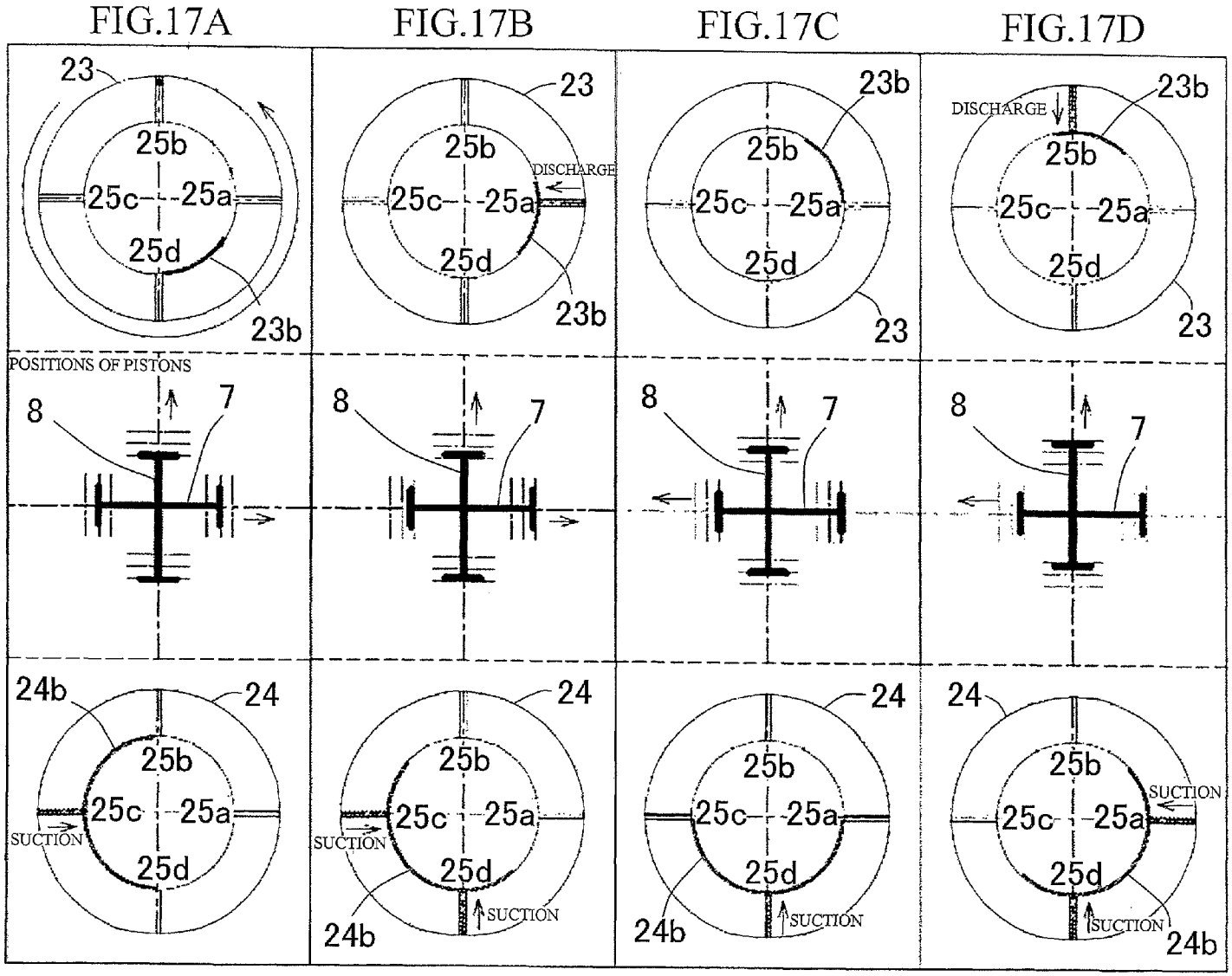
FIGS. 17A-17D are schematic views showing transition between the suction and the discharge of the first and second rotary valves according to positions of the pistons.

In FIG. 17A, the first double-headed piston 7 is in the middle of moving rightward, and the second double-headed piston 8 is located at the lower end. In this state, the fluid is compressed without being discharged via the first rotary valve 23, and the fluid is sucked into the cylinder chamber 25*c* via the second rotary valve 24.

In FIG. 17B, the first double-headed piston 7 is located just short of the right end, and the second double-headed piston 8 has just started to move upward. In this state, the fluid is discharged from the cylinder chamber 25*a* via the first rotary valve 23, and the fluid is sucked into the cylinder chambers 25*c* and 25*d* via the second rotary valve 24.

In FIG. 17C, the first double-headed piston 7 is located at the right end, and the second double-headed piston 8 is in the middle of moving upward. In this state, the fluid is compressed without being discharged via the first rotary valve 23, and the fluid is sucked into the cylinder chamber 25*d* via the second rotary valve 24.

In FIG. 17D, the first double-headed piston 7 has just started to move leftward, and the second double-headed piston 8 is located just short of the upper end. In this state, the fluid is discharged from the cylinder chamber 25*b* via the first rotary valve 23, and the fluid is sucked into the cylinder chambers 25*d* and 25*a* via the second rotary valve 24.

Figures 18A, 18B, 18C, 18D:
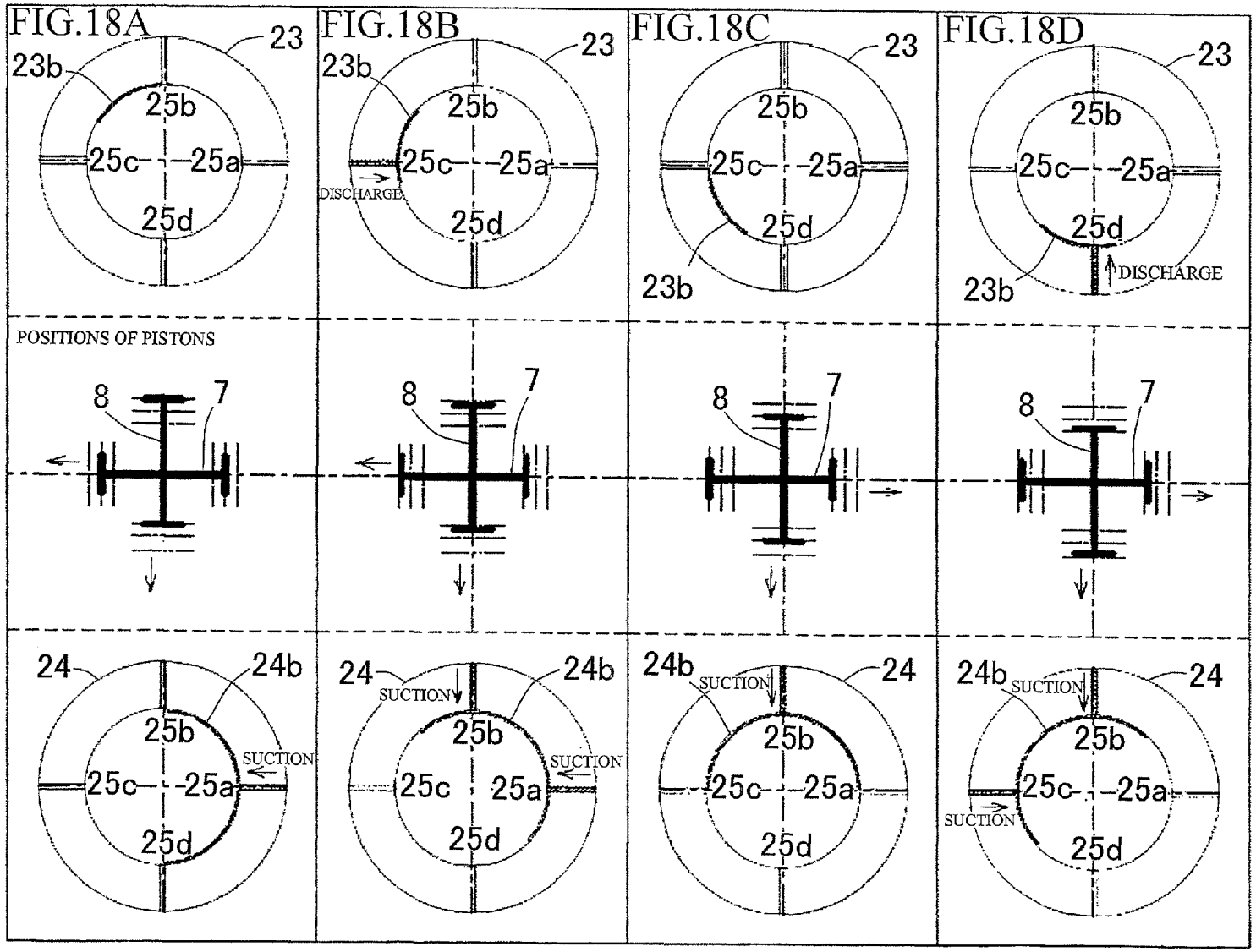
FIGS. 18A-18D are schematic views showing transition between the suction and the discharge of the first and second rotary valves according to positions of the pistons.

In FIG. 18A, the first double-headed piston 7 is in the middle of moving leftward, and the second double-headed piston 8 is located at the upper end. In this state, the fluid is compressed without being discharged via the first rotary valve 23, and the fluid is sucked into the cylinder chamber 25*a* via the second rotary valve 24.

In FIG. 18B, the first double-headed piston 7 is located just short of the left end, and the second double-headed piston 8 has just started to move downward. In this state, the fluid is discharged from the cylinder chamber 25*c* via the first rotary valve 23, and the fluid is sucked into the cylinder chambers 25*a* and 25*b* via the second rotary valve 24.

In FIG. 18C, the first double-headed piston 7 is located at the left end, and the second double-headed piston 8 is in the middle of moving downward. In this state, the fluid is compressed without being discharged via the first rotary valve 23, and the fluid is sucked into the cylinder chamber 25*b* via the second rotary valve 24.

In FIG. 18D, the first double-headed piston 7 has just started to move rightward, and the second double-headed piston 8 is located just short of the lower end. In this state, the fluid is discharged from the cylinder chamber 25*d* via the first rotary valve 23, and the fluid is sucked into the cylinder chambers 25*b* and 25*c* via the second rotary valve 24.

Then, the state is returned to the state shown in FIG. 17A, and the above described sucking and discharging operations are repeated. By performing the above described actions, a high pressure pump capable of minimizing pressure loss of the fluid can be provided.

Figure 19A:
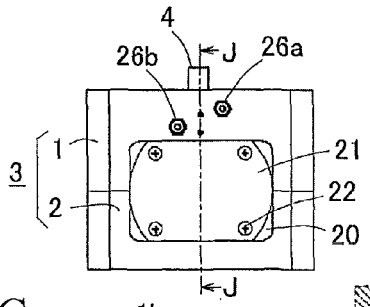
FIGS. 19A-19D are a front view, a perspective view, a sectional view taken along a line J-J of a fluid rotary machine, in which the rotary valves are disposed on one of the first and second balance weights side and a partial sectional view of a sealing structure between the case and the rotary valve.
Figure 19B:
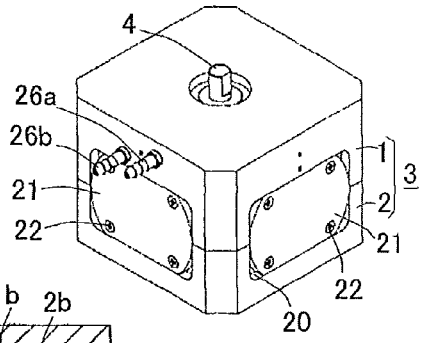
Figure 19C:
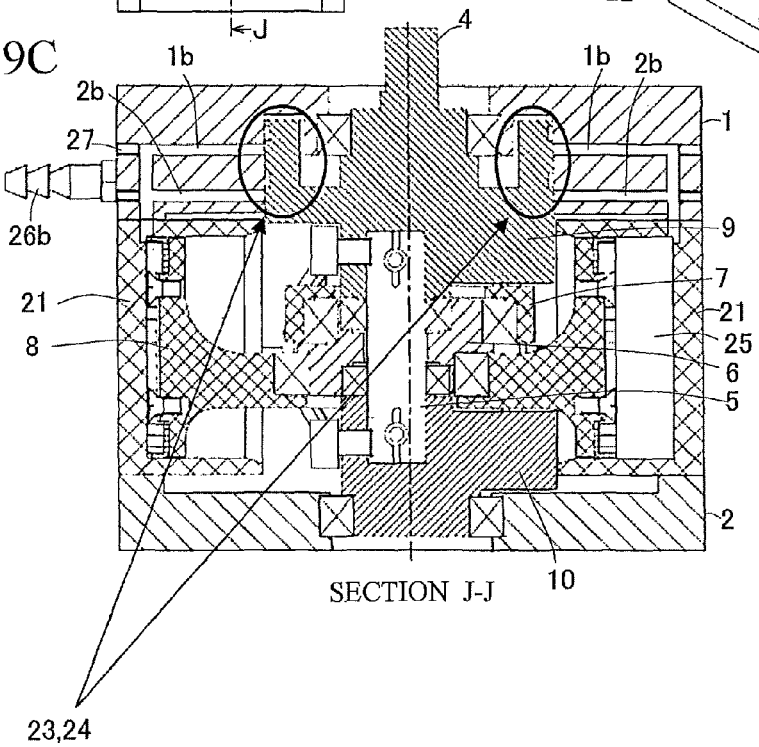

As shown in FIGS. 19A-19D, the first and second rotary valves 23 and 24 may be integrated with one of the first and second balance weights 9 and 20 which are rotatably held in the case 3. In FIGS. 19A-19C, the tube connectors 26*a* and 26*b* are provided to the first case part 1.

As shown in FIGS. 20A-20E, a thickness of the first rotary valve 23, in the axial direction of the first balance weight 9, is increased, and a pair of the passage grooves are formed. Namely, the circular groove sections 23*a* and 24*a*, which have a prescribed width, are formed on the entire outer circumferential face of the valve, and the wide groove sections 23*b* and 24*b* are partially formed in the circular groove sections. With this structure, the fluid path for suction and the fluid path for discharge can be formed on the axial one side of the first crank shaft 5.

The wide groove sections 23*b* and 24*b* are alternately formed, in the axial direction, in a mutually complementary manner. With this structure, switching between the suction and discharge via the wide groove sections 23*b* and 24*b* can be performed, the balance of the first and second balance weights 9 and 10 can be easily achieved and vibration caused by the rotation can be restrained, so that noise can be reduced. Note that, as shown in FIG. 20C, the wide groove sections 23*b* and 24*b* are respectively shifted a distance R, which is equal to a width R half of the first and the second fluid paths, so that switching between the suction and discharge can be performed smoothly.

Figure 19D:
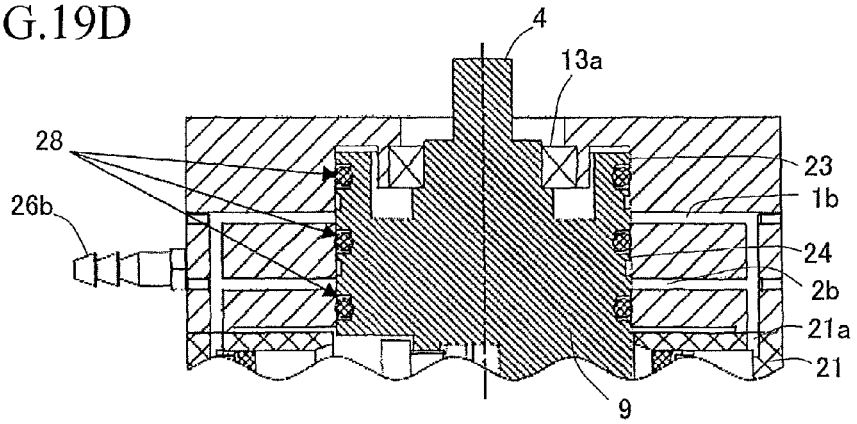

In FIGS. 19C and 19D, the first fluid paths 1*a* and 2*a* (not shown), which communicate the circular groove sections 23*a* and 24*a* to an external path, and the second fluid paths 1*b* and 2*b*, which communicate the wide groove sections 23*b* and 24*b* to the cylinder chambers 25, are formed in the first case part 1. Note that, in the above described embodiment, the rotary valves and the first and second fluid paths are provided in the first case part 1, but they may be provided to the second case part 2.

In the above described embodiment, the first and the second rotary valves 23 and 24 are integrated with the first and second balance weights 9 and 10; in case that a sufficient clearance cannot be formed due to an assembly error of a fitting part between the rotary valve, the case 3 (the first case part 1 or the second case part 2) and the cylinder 21 and the rotary valve cannot be smoothly turned as shown in FIG. 21A, the rotary valve and the balance weight may be separated. An example of the first balance weight 9 and the first rotary valve 23 will be explained.

In FIGS. 21B-21E, the ring-shaped rotary valve 23 is attached to an end face of the first balance weight 9 integrated with the shaft 4 on the shaft 4 side. As shown in FIGS. 21F and 21G, the circular groove section 23*a* is formed on the entire outer circumferential face of the first rotary valve 23, and the wide groove section 23*b* is partially formed, within a prescribed range, in the circular groove section 23*a*. Projected sections 23*c* are projected from a bottom face of the first rotary valve 23 to face each other. Concave sections 9*d* are formed in a flange 9*c* of the first balance weight 9 to face each other.

The first rotary valve 23 is integrated by engaging the projected sections 23*c* with the concave sections 9*d* of the flange 9*c* of the first balance weight 9 (see FIGS. 21B, 21C and 21D). With this structure, as shown in FIG. 21H, even if a clearance between the first case part 1 and the cylinder 21 is partially insufficient when the first rotary valve is incorporated into the end part of the first crank shaft 5, an assembly error can be absorbed by a radial clearance of the first rotary valve 23.

Next, a further embodiment of the fluid rotary machine will be explained with reference to FIGS. 22 and 26A-26E.

In the present embodiment, resin-molded parts are used, as much as possible, to act as functional parts, so that number of parts and production cost can be reduced.

Figure 25:
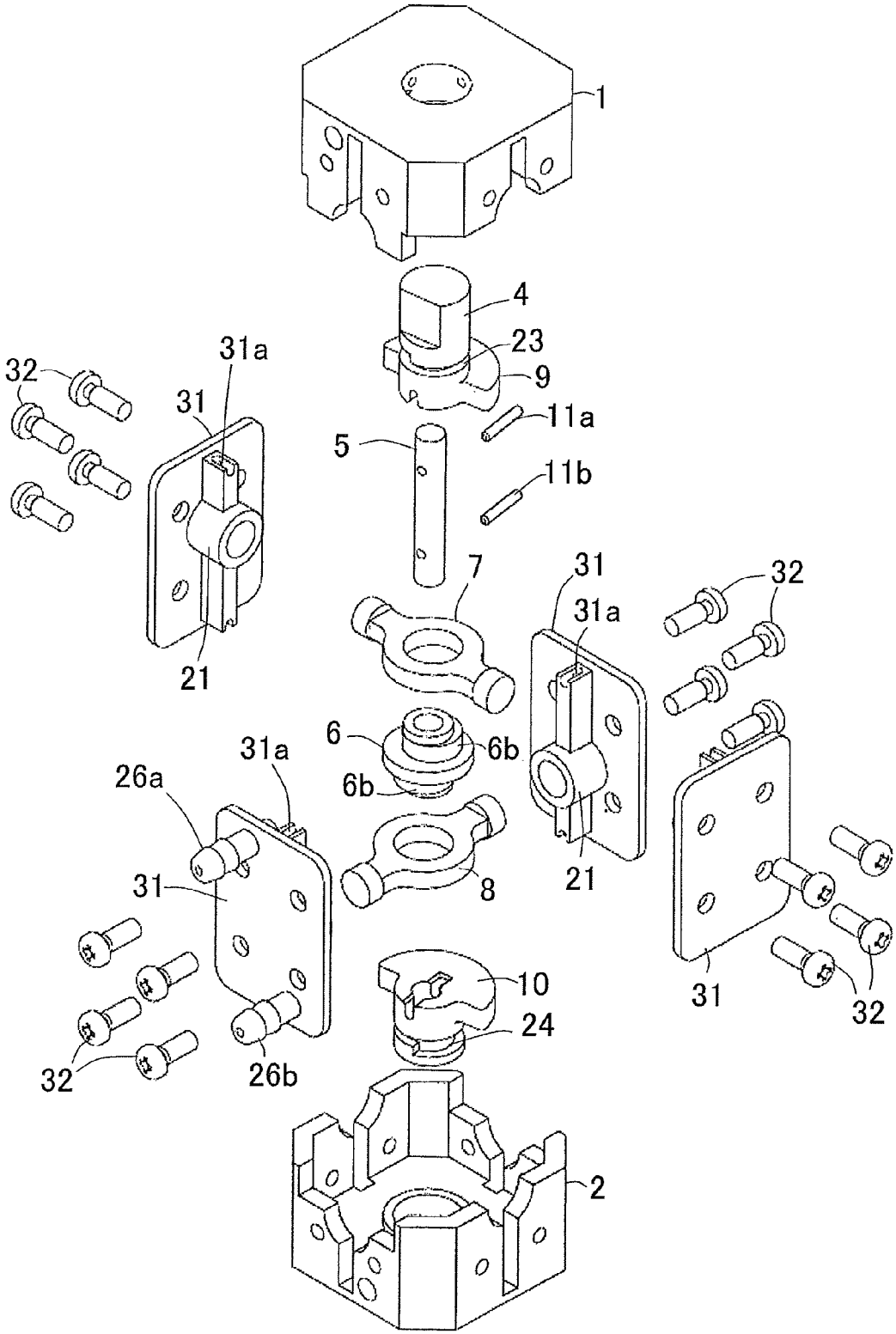
FIG. 25 An exploded perspective view of the fluid rotary machine shown in FIG. 22.
Figure 26E:
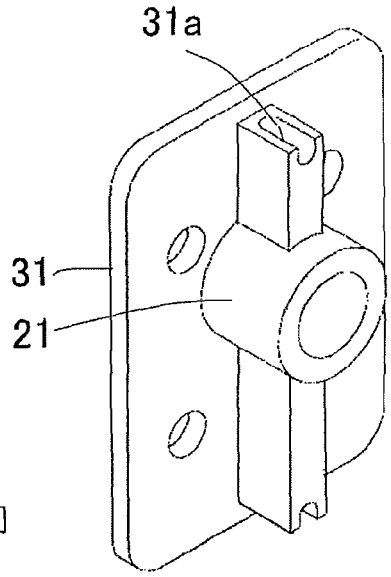
FIGS. 26A-26E are a front view, a left side view, a plan view, a sectional view taken along a line L-L and a perspective view of the cylinder.
Figure 26C:
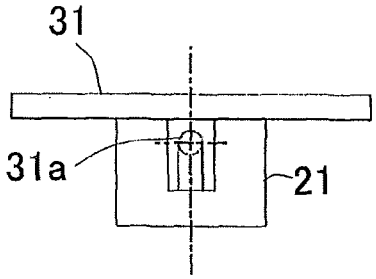
Figure 26B:
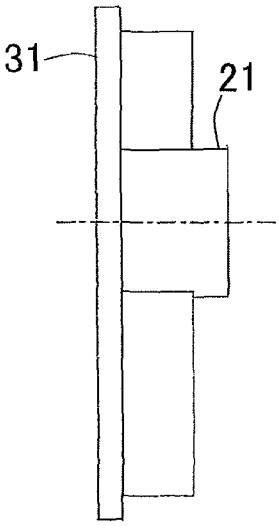
Figure 26A:
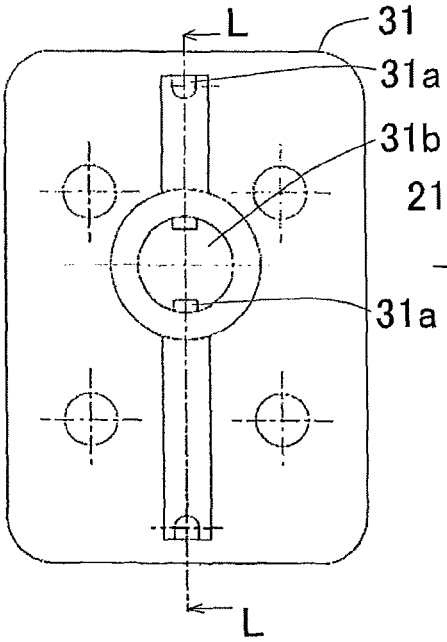
Figure 26D:
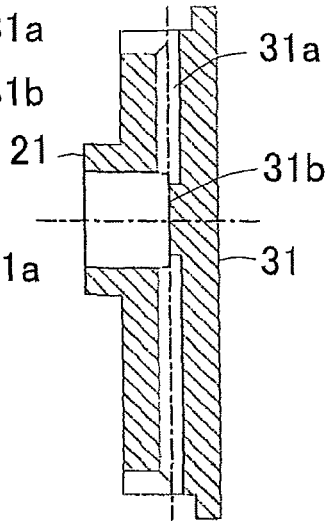
Figure 27:
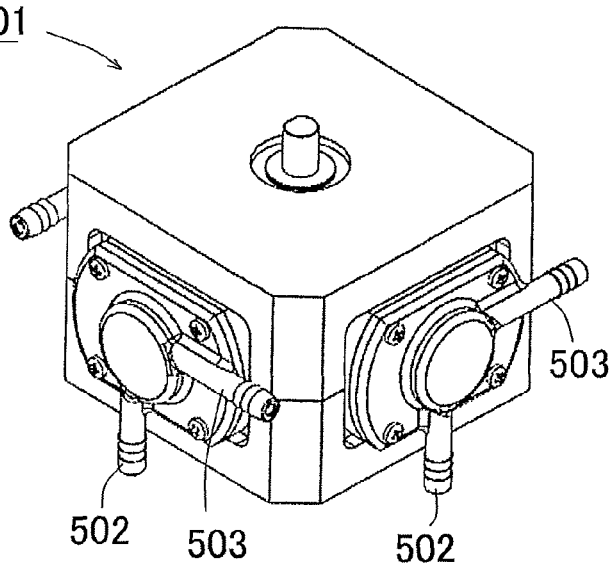
FIG.27 PRIOR ART
FIG. 27 A perspective view showing the valve structure of the conventional fluid rotary machine.
Figure 28:
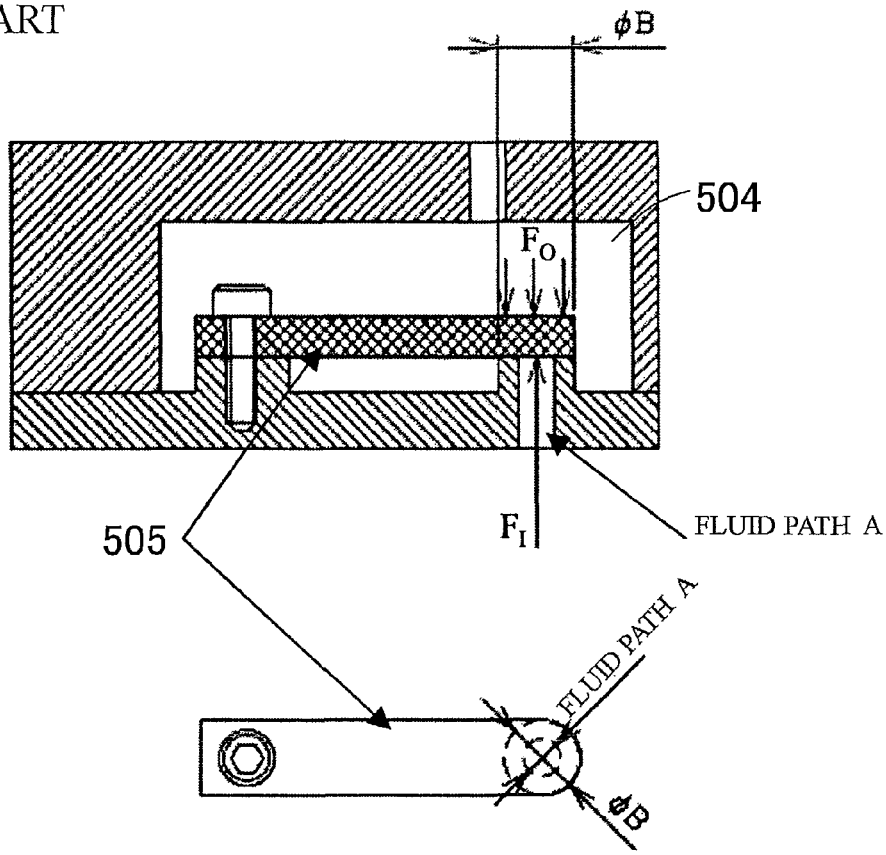
FIG.28 PRIOR ART
FIG. 28 An explanation view showing the structure of the suction valve (open-close valve).

In an exploded perspective view of FIG. 25, the first case part 1, the second case part 2, the shaft 4, the first rotary valve 23, the second rotary valve 24, the first balance weight 9, the eccentric tube body 6, the first and second double-headed pistons 7 and 8, the second balance weight 10, the second rotary valve 24 and outer wall panels 31 including the cylinders 21 are formed by resin molding.

Only the first crank shaft 5, the pins 11*a* and 11*b* and bolts 32 are metallic parts. Note that, bearings are omitted because the resin has enough sliding property, and number of bolts are minimized.

Figure 22:
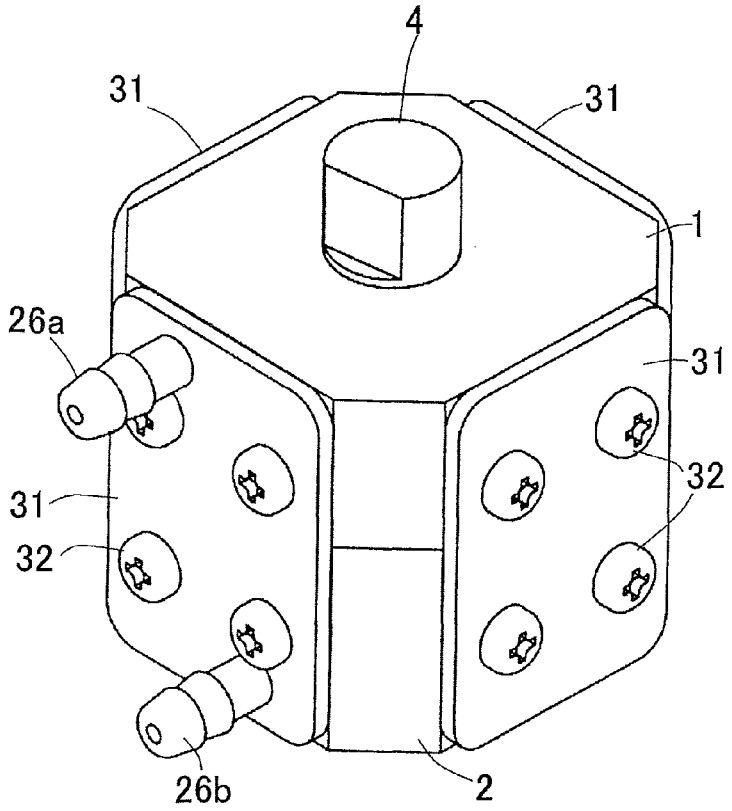
FIG. 22 A perspective view of a further embodiment of the fluid rotary machine.

In FIG. 22, the outer wall panels 31 are fixed on the four side faces of the first and second case parts 1 and 2 by the bolts 32, so that the case 3 is formed. Note that, the tube connectors 26*a* and 26*b* are integrally formed in one of the outer wall panels 31.

Figure 23:
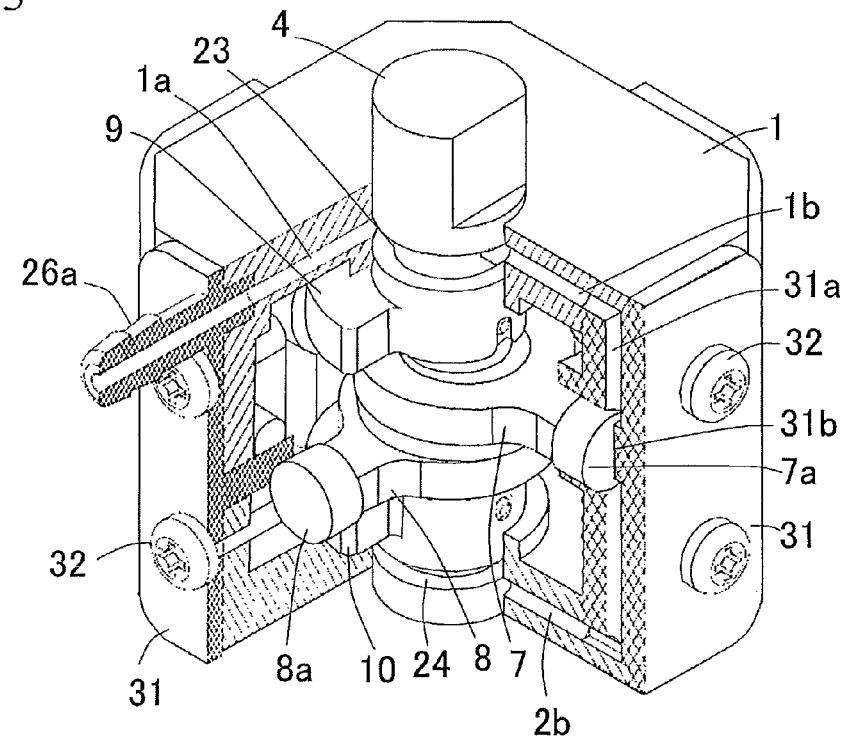
FIG. 23 A partially cutaway view of the fluid rotary machine shown in FIG. 22.
Figure 24:
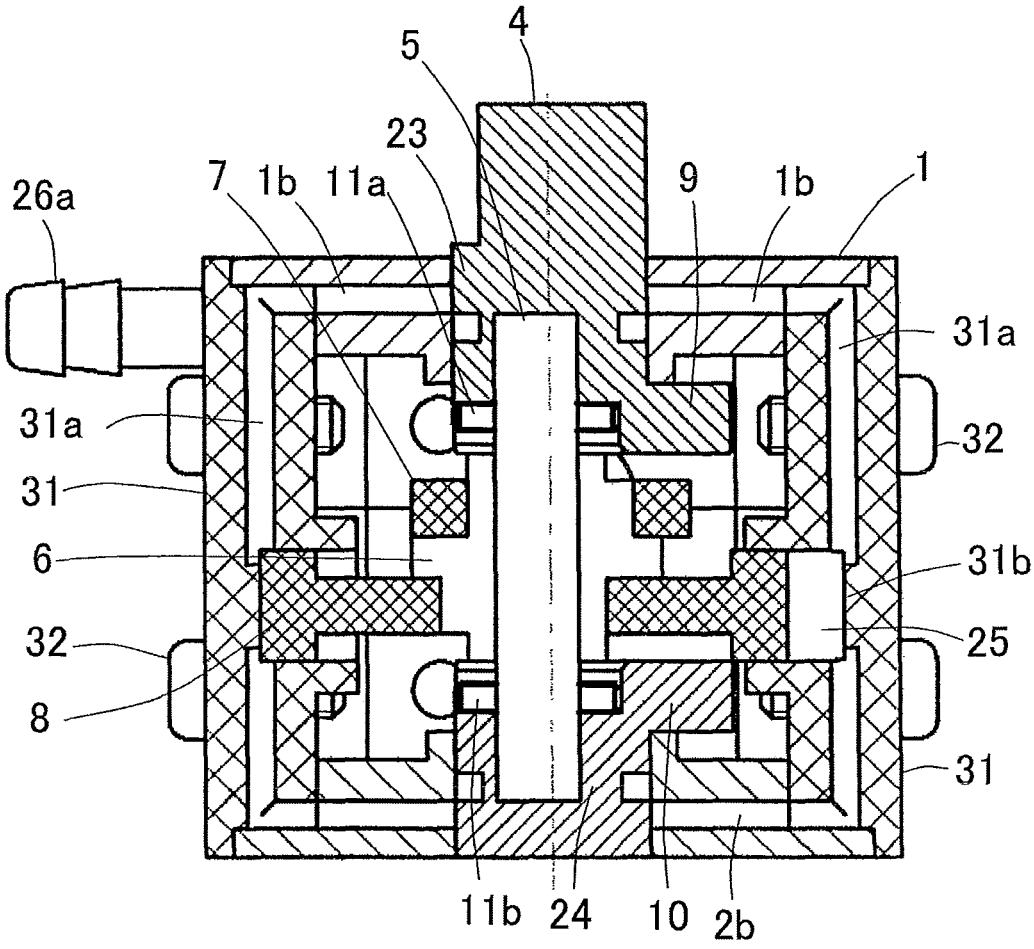
FIG. 24 A vertical sectional view of the fluid rotary machine shown in FIG. 22.

As shown in FIGS. 23 and 24, an outer end of the first fluid path 1*a* of the first case part 1 is connected to the tube connector 26*a*, and an inner end thereof is connected to the passage groove (the circular groove section 23*a* and the wide groove section 23*b*) of the first rotary valve 23. Further, outer ends of the second fluid paths 1*b* and 2*b* of the first and second case parts 1 and 2 are connected to fluid paths 31*a* which are respectively formed on inner faces of the outer wall panels 31, and inner ends thereof are connected to the passage grooves (the circular groove sections 23*a* and 24*a* and the wide groove sections 23*b* and 24*b*) of the first and second rotary valves 23 and 24.

As shown in FIGS. 26A-26E, the cylinder 21 is integrally formed on the inner face of each outer wall panel 31, and the fluid path 31*a* connected to the cylinder 21 is also integrally formed thereon. A piston-receiving section 31*b*, which divides the fluid path 31*a*, is formed in a piston-facing part of the fluid path 31*a*. The piston-receiving section 31*b* is disposed without mechanically interfering with ends of the first and second double-headed pistons 7 and 8. By integrally forming the cylinder 21 and the fluid path 31*a* in the outer wall panel 31, number of parts and number of screwed points can be reduced.

Note that, the shape of the first and second piston heads 7*a* and 8*a* is not limited to the circular columnar shape, it may be, for example, a prismatic columnar shape.

In the above described embodiments, the fluid rotary machine has a pair of the double-headed pistons, number of the pistons may be three or more.

The first and second double-headed pistons 7 and 8 are arranged in the crisscross arrangement, but the arrangement is not limited, the pistons may be arranged around the first crank shaft 5 at angular intervals of, for example, 60 degrees.

Further, air may be multistage-compressed by using four cylinder heads. In this case, strokes of the double-headed pistons cannot be changed, so diameters of the pistons and the cylinders are changed.

As described above, the sucking operation and the discharge operation of the fluid in each of the cylinder chambers 25 are switched by the rotary valves 23 and 24, which are incorporated into the case 3 to be coaxial and integrally rotatable with the shaft 4, pipes or tubes connected to an inlet and an outlet communicated to each of the cylinder chambers 25 can be brought together, so that the footprint of the machine can be decreased by reducing number of parts and simplifying valve structure as well as by reducing externally coupled pipes or tubes used for suction and discharge of the fluid.

In the above described embodiments, the seal cups are used to seal between the pistons and cylinders, but piston rings may be used instead. The liquid pump and the air pump have been explained as the embodiments, the fluid rotary machine is not limited to the above described embodiments, so the present invention may be applied to a vacuum pump, a pneumatic compressor, a multistage compressor, a fluid motor, etc.

What is claimed is:

1. A four-head fluid rotary machine comprising: a first crank shaft being eccentrically connected to a shaft, the first crank shaft being rotated about the shaft by a first imaginary crank arm which has a radius r; a piston composite body having an eccentric tube body constituted by a first tube body, which is concentrically fitted to the first crank shaft, and second tube bodies, which are extended from respective axial ends of the first tube body and whose axes are second imaginary crank shafts eccentrically disposed with respect to an axis of the first tube body, a first double-headed piston, which is fitted in one of the second tube bodies, and a second double-headed piston, which is fitted in the other second tube body, the double-headed pistons being disposed inside cylinders in a crisscross arrangement, the piston composite body being rotated about the first crank shaft by a second imaginary crank arm which has a radius r; and first and second balance weights being inserted and incorporated into respective ends of the first crank shaft, wherein the double-headed pistons linearly reciprocate in the cylinders in a state where a first rotational balance relating to the first and second double-headed pistons around the second imaginary crank shafts, a second rotational balance relating to the piston composite body around the first crank shaft and a third rotational balance relating to the first crank shaft and the piston composite body around the shaft are achieved only by the first and second balance weights, said fluid rotary machine being characterized in that rotary valves switch between suction and discharge operations of a fluid for chambers of the cylinders, and that the rotary valves are incorporated into a case to be coaxial and integrally rotatable with the shaft.

2. The fluid rotary machine according to claim 1, wherein the rotary valves are suction valves and discharge valves.

3. The fluid rotary machine according to claim 1, wherein a passage groove whose width is partially varied is formed on an outer circumferential face of each of the rotary valves and extended in a circumferential direction, and a first fluid path, which communicates the passage groove to an external path, and a second fluid path, which communicates the passage groove to the cylinder chambers, are formed in the case.

4. The fluid rotary machine according to claim 2, wherein a passage groove whose width is partially varied is formed on an outer circumferential face of each of the rotary valves and extended in a circumferential direction, and a first fluid path, which communicates the passage groove to an external path, and a second fluid path, which communicates the passage groove to the cylinder chambers, are formed in the case.

5. The fluid rotary machine according to claim 3, wherein the rotary valves are integrated with the first and second balance weights, which are respectively incorporated into the axial ends of the first crank shaft, each of the passage grooves has a circular groove section, which has a prescribed width and formed on an entire outer circumferential face of the rotary valve, and a wide groove section, which is wider than the circular groove section, and the wide groove sections of the rotary valves are point-symmetrically formed with respect to the axis of the shaft.

6. The fluid rotary machine according to claim 3, wherein the rotary valve for discharge and the rotary valve for suction are integrated with the first and second balance weights, respectively, which are rotatably held by the case, and have a pair of the passage grooves, each of which has a circular groove section having a prescribed width and being formed on an entire outer circumferential face of each rotary valve, and a wide groove section, which is wider than the circular groove section, and the wide groove sections of the passage grooves are alternately formed, in the axial direction, in a mutually complementary manner.

* * * * *

UNITED STATES PATENT AND TRADEMARK OFFICE

CERTIFICATE OF CORRECTION

PATENT NO. : 8,608,455 B2
APPLICATION NO. : 13/704035
DATED : December 17, 2013
INVENTOR(S) : Naoya Ishida et al.

It is certified that error appears in the above-identified patent and that said Letters Patent is hereby corrected as shown below:

ON THE TITLE PAGE:

At item (73), correct the Assignees to read as follows:

--Nippo Ltd., Osaka (JP); Yugen Kaisha K.R & D, Nagano (JP)--.

Signed and Sealed this
Eighth Day of April, 2014

Michelle K. Lee

Michelle K. Lee
*Deputy Director of the United States Patent and Trademark Office*